US006329585B1

(12) United States Patent
Chono

(10) Patent No.: US 6,329,585 B1
(45) Date of Patent: Dec. 11, 2001

(54) KEYBOARD MUSICAL INSTRUMENT

(76) Inventor: Yasuhiro Chono, Room No. 201, Rose Mension 30-21, Takadanobaba 4-chome, Shinjuku-ku, Tokyo 169-0075 (JP)

( * ) Notice: Subject to any disclaimer, the term of this patent is extended or adjusted under 35 U.S.C. 154(b) by 0 days.

(21) Appl. No.: 09/701,959

(22) PCT Filed: Feb. 29, 2000

(86) PCT No.: PCT/JP00/01174

§ 371 Date: Feb. 28, 2001

§ 102(e) Date: Feb. 28, 2001

(87) PCT Pub. No.: WO00/62277

PCT Pub. Date: Oct. 19, 2000

(30) Foreign Application Priority Data

Apr. 8, 1999 (JP) ..... 11-136124

(51) Int. Cl.[7] ..... G10D 13/02
(52) U.S. Cl. ..... 84/423 R
(58) Field of Search ..... 84/423 R, 424, 84/428, 427, 435, 429, 430, 432, 433, 434, 438

(56) References Cited

U.S. PATENT DOCUMENTS 5,945,617 * 8/1999 Nitsuma ..... 84/423 R
6,051,767 * 4/2000 Masubuchi ..... 84/423 R
6,051,768 * 4/2000 Masubuchi ..... 84/423 R
6,087,574 * 7/2000 Kitashima et al. ..... 84/423 R

* cited by examiner

*Primary Examiner*—Robert E. Nappi
*Assistant Examiner*—Kim Lockett
(74) *Attorney, Agent, or Firm*—Hogan & Hartson, L.L.P.

(57) ABSTRACT

An action mechanism 1 inside a keyboard musical instrument of the present invention is the jumping-up style, and has a configuration in which a beak-like projecting piece 19 is protrudingly provided in a base end portion of a hammer body 9, an engaging stepped portion 31 is formed in an escapement member 11 that is always biased toward the beak-like projecting piece 19 of the hammer body 9, a pivotally attached portion of the hammer body 9 pivots in the striking direction in accordance with a striking operation, and at the same time, the beak-like projecting piece 19 and the engaging stepped portion 31 engage, and the hammer body 9 performs a striking pivotal operation against a sound source body 7. Then, in at least one of the base end portion of the hammer body 9 and the escapement member 11, there is provided a pushing-out member 21 for pushing out the escapement member 11 in the opposite side with respect to the hammer body 9 to let off the beak-like projecting piece 19 from the engaging stepped portion 31, and at the same time, a control member 33 for separating the hammer body 9 from the sound source body 7 to stop it in the state in which the beak-like projecting piece 19 is let off from the engaging stepped portion 31 is integrally formed in the escapement member 11. Further, the control member may be provided in a fixed portion without integrally forming with the escapement member 11.

9 Claims, 30 Drawing Sheets

KEYBOARD MUSICAL INSTRUMENT

TECHNICAL FIELD

The present invention relates to a keyboard musical instrument for striking a sound generating body in response to key striking operation on a keyboard portion, and is particularly preferable when applied to a keyboard musical instrument having an action mechanism called the jumping-up style.

BACKGROUND ART

Currently, action mechanisms of the same style are mounted in keyboard musical instruments for performing a hammer action, such as a piano, although the action mechanisms are somewhat different from one keyboard musical instrument to another concerning a standard. That is, an English style action mechanism called the pushing-up style is employed in a modern piano.

However, in the nineteenth century, an action mechanism of the German style or the Viennese style called the jumping-up style was widely known as other mechanisms aside from this pushing-up style. Such a mechanism in the past, the historical transition of the jumping-up style to be described later, and the like are discussed in a book entitled "Vom Hammer" written by Walter Pfeiffer and published in 1979 (third edition). Further, the inventor of the present invention was interested in a keyboard musical instrument of this style and was inspired to start the manufacture of such a keyboard musical instrument by seeing photographs of a musical instrument Orphica, before confirming the contents of this book (approximately fifteen years ago).

Basic characteristics of this jumping-up style is that a rotational central axis of a hammer is attached to a key. The most important progress in an action mechanism of this jumping-up style was made in the eighteenth century. That is, Johann Andoreas Stein (1728 to 1792) devised excellent touch of playing by mounting tongue-like components independent for each key instead of parts to which beak-like protrusions of hammers existing in the rearward of keys that were arranged in a fixed rail shape hook on. This was the most important advance of the jumping-up style action mechanism, and determined the jumping-up style action mechanism.

The Stein's action mechanism did not have a back-check (an object serving to stop the motion of a hammer that strikes a string and jumps back after striking the string). However, it may be considered that it was Stein's achievement to have created the basic form of the German style action mechanism and have determined a final form of an action mechanism that is hard to jump.

The world famous Viennese style action mechanism was taken over by Nanette who was Stein's daughter, and by her husband Johann Andoreas Streicher who was a manufacturer of keyboard musical instruments, and its originality was further developed. Therefore, the action mechanism was called the Viennese style instead of the German style when Stein's daughter Nanette got married to the Viennese man, and the action mechanism is often written as "the German Viennese style action mechanism" because both the German and Viennese styles have the same roots.

The improvement of Stein's style having the tongue-like components independent for each key (see, for example, FIG. 31) has very light touch (feeling of play), does not cause any sense of increased pressure by let-off (motion or function for separating the motion of a key and the motion of a hammer before the hammer and a string collide with each other) to a player, and is easy to repeat striking keys. A key has the depth of approximately 6 millimeters and the heaviness (a value in grams at which a key is depressed) of 30 grams in bass range and 20 grams in treble range.

On the other hand, when a key is depressed, a current piano experiences increase of relatively large resistance, i.e., force of a key to push back at the time of let-off. The depth of a key is 9.5 to 10 millimeters. A grand piano of Steinway is a typical one of the few pianos whose heaviness of a key is low at approximately 47 grams in average.

Although such an improvement was added to the jumping-up style action mechanism, the trend of the world was in favor of the pushing-up style. This is because a decisive improvement, which is now practical, was added to the English style action mechanism which is a pushing-up style. That is the repetition action mechanism, which was invented in 1821 and then was evolved into the current grand piano action mechanism by further improvement in 1840.

A piano action cannot be prepared for the next string striking unless a key rises to "a certain height" by a performer lifting a finger after the key is depressed to generate sound (a string is struck) once. The repetition action mechanism is a mechanism that is devised such that "a certain height" required for preparation of string striking is as low as possible. With this mechanism, the function of repeated striking (to make repeated striking easy) can be improved.

As far as the inventor of the present invention knows, upright pianos except limited models of two manufacturing companies in the world do not have this function. Therefore, this function is a point for comparing performability of an upright piano and a grand piano. This is called "Kurzhubwerk" in German, which means "the lifting height lowering function".

Moreover, the jumping-up style (the Vienna style) action mechanism had a critical structural problem. The inventor of the present invention also noticed the problem when the inventor tried to manufacture a keyboard musical instrument once approximately fifteen years ago, but did not notice that this problem is discussed in the literature "Vom Hammer" until recently. The structural problem that the Vienna style action mechanism has is namely that the rotational central axis of a hammer portion shifts in accordance with the movement of a key. This causes inconveniences described below.

Usually, it is common to assume the state in which a key is depressed to the lowest point when a string is struck, but a different state may be assumed, for example, a state in which a string is struck by instantly hitting a key with strong force. In other words, this state corresponds to staccato of forte.

In this case, although a hammer jumps up by the reaction of instant hit of a key with strong force to strike a string, the key is not in a state that it is fully depressed to the lowest point, but is somewhere on its way to the lowest point. In the Vienna style action mechanism, since the rotational central axis of the hammer is attached to the key, the position of the rotational central axis of the hammer at that time is in the position lower than the state where the key depressed is to the lowest point. As a result, since the positions of the rotational central axis of the hammer are different respectively in each of the above-mentioned two states, the hammer reaches the string forming different tracks in each state, and parts of the hammer head contacting the string are also different respectively.

Since a dislocation of the string striking point (the point where the hammer head contacts the string) arises in the longitudinal direction viewed from a performer, if strings are stretched in rows to cross the direction to which keys extend, the hammer not only does not strike an aimed string but may strike another string or a plurality of unnecessary strings of different sounds simultaneously. In addition, in the hammer side, since the large area of the hammer head contacts the strings at unspecified points, tones also become unstable and sound quality cannot be adjusted.

A Vienna style action mechanism 373 that adopts the above-mentioned jumping-up style is illustrated in FIGS. 31 through 34. As shown in FIG. 31, a keyboard body 305 having a keyboard portion (not shown) in the right side (in the figure) is swingably held by a pin 313 and a pedestal 315. A supporting pole 375 is provided at the other end portion of the keyboard body 305, and a base portion of a hammer body 377 is pivotally supported by a rotational central axis 378 at the top end of the supporting pole 375 to strike a string 307.

A beak-like projecting piece 379 is mounted on the base end portion of the hammer body 377. An engaging stepped portion 383 is formed in an escapement member 381 that is always biased toward this beak-like projecting piece 379 of the hammer body 377 by a spring bar 380. On the other hand, a back-check 389 is mounted on a frame 385 along the rotational track of the hammer portion 387 of the hammer body 377, and a sliding member such as leather is stuck on the surface of the back-check 389.

In a performance, as shown in FIGS. 32 and 33, the supporting pole 375 in the other end of the keyboard body 305 rises toward the string 307, and at the same time, the beak-like projecting piece 379 of the hammer body 377 and the engaging stepped portion 383 of the escapement member 381 are engaged, in accordance with the key striking operation of the keyboard portion. In this way, the hammer body 377 performs a striking pivotal operation against the string 307.

The engagement of the beak-line projecting piece 379 of the hammer body 377 and the engaging stepped portion 383 of the escapement member 381 is designed to be let off as shown in FIG. 33 immediately before the striking operation of the hammer body 377. The timing of this let-off can be adjusted exactly by an adjustment screw 391. When the performer sets the keyboard portion free, the let off beak-like projecting piece 379 descends while sliding against a return sliding surface 393 of the escapement member 381 as shown in FIG. 34, and returns to the state shown in FIG. 31. In addition, a hammer body 377, after striking the string 307, is caused to return in the direction of its original position by strong repulsion of the string 307, but the force of the movement is reduced by sliding friction between the hammer portion 387 of the hammer body 377 and the back-check 389, and the hammer body 377 stops. Therefore, the hammer body 377 does not rebound to strike the string 307 again.

The let-off of the Viennese style action mechanism 371 utilizes the shift of the rotational central axis 378 of the hammer body 377 in the longitudinal direction viewed from the performer by swinging movement of the keyboard body 305. That is, let-off is effected when the top end of the beak-like projecting piece 379 in the opposite side of the hammer portion 387 moves as if it is pulled out from the escapement member 381, by depressing the keyboard portion.

Therefore, the more a reliable movement of let-off is desired, the longer the shifting distance of the rotational central axis 378 must be made by separating the rotational central axis 378 from the keyboard body 305 and placing it in a higher position. In addition, since the back-check 389 is required to be placed correspondingly in a higher position as well, it is hard to design the action mechanism 373 to be low in height. Further, since it is necessary to provide the back-check 389 and to adjust its condition of striking, there is also a problem that the number of components and the number of assembly steps are many.

Moreover, in the conventional Vienna style action mechanism 373, since the entire action mechanism 373 protrudes to the other side of the keyboard portion by the length L (see FIG. 31) that includes the part from the striking point of the hammer portion 387 of the hammer body 377 to the mounting positions of the hammer body 377 and the escapement member 381, it is hard to design the entire keyboard musical instrument to be shallow in depth. In addition, when the hammer body 377 is larger, the rotational central axis 378 of the hammer body 377 must be placed in a higher position, which, on the other hand, results in larger dislocation of a string striking point on the hammer portion 387.

DISCLOSURE OF THE INVENTION

The present invention has been devised for the purpose of solving these problems, and it is an object of the present invention to provide a jumping-up style keyboard musical instruments that can be designed lower in height and shallower in depth while restraining a dislocation of a string striking point and has a fewer number of components and a fewer number of assembly steps. It is another object of the present invention to provide a jumping-up style keyboard musical instrument that can be played in a tilted state in as standing play.

In line with these objects, the inventor of the present invention started the second challenge concerning the manufacture of a keyboard musical instrument approximately three years ago. Then, a first trial product that had good appearance (function) as a musical instrument was completed in March 1998. Thereafter, it was confirmed by an action analysis of a third trial product by a personal computer that it is difficult to alter the dimensions of major parts such as an engaging portion of a hammer body and an escapement member. Currently, a fifth trial product is being manufactured. Under such circumstances, this application is filed in order to protect novel mechanisms whose performances have been confirmed.

The present invention provides a keyboard musical instrument with a configuration in which a middle part in the longitudinal direction of a keyboard body having a keyboard portion at its one end is swingably held and, at the same time, a base of a hammer body for striking is pivotally attached to the opposite side of the keyboard portion across the holding point of the keyboard body; a beak-like projecting piece is protrudingly provided in a base end of the hammer body and, at the same time, an engaging stepped portion is formed in an escapement member that is always biased toward the beak-like projecting piece of the hammer body; the pivotally attached portion of the hammer body pivots in accordance with a key striking operation of the keyboard portion and, at the same time, the beak-like projecting piece of the hammer body and the engaging stepped portion of the escapement member engage; and the hammer body performs a striking pivotal operation against a sound source body. In this way, since the base of the hammer body is pivotally mounted on the keyboard body directly, a dislocation of a striking point can be controlled and, at the same time, the height of an action mechanism can be made low.

In addition, the present invention provides, in at least one of the base end of the hammer body and the escapement member, a pushing-out member for pushing out the escapement member to the opposite side with respect to the hammer body in accordance with the striking pivotal operation of the hammer body to let off the beak-like piece of the hammer body from the engaging stepped portion and, at the same time, integrally forms in the escapement member a control member contactably and separably opposing the hammer body in the striking direction that separates the hammer body from the sound source body and stopping it in the state in which the beak-like projecting piece is let off from the engaging stepped portion.

In this way, since at least one of the base end of the hammer body and the escapement member is provided with a pushing-out member for pushing out the escapement member to the opposite side in respect to the hammer body to separate the projecting piece of the hammer body from the engaging stepped portion in accordance with a striking pivotal movement of the hammer body, the beak-like projecting piece can be forced to separate from the engaging stepped portion of the escapement member. Therefore, since a member such as the supporting pole 375 for increasing a shifting component in the horizontal direction (the direction toward keyboard portion) of the beak-like projecting piece 379 as conventionally required becomes unnecessary, the length of the keyboard body can be designed short, the height of the action mechanism can be designed extremely low, and the depth extremely shallow.

In addition, since the control member is integrally formed in the escapement member for separably opposing the hammer body in the striking direction and separating the hammer body from the sound source body to stop in the state in which the beak-like projecting piece is separated from the engaging stepped portion, the back-check 389 as required in the conventional art becomes unnecessary, and the number of components and the number of assembly steps can be reduced. In addition, the height of the action mechanism portion can be made low.

A keyboard musical instrument in accordance with another invention comprises a keyboard body that has a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and at least one of the hammer body and the escapement member is provided with a pushing-out member for pushing out the escapement member to the opposite side with respect to the hammer body to separate the projecting piece of the hammer body from the engaging stepped portion in accordance with a striking pivotal movement of the hammer body.

In this way, since at least one of the base end of the hammer body and the escapement member is provided with a pushing-out member for pushing out the escapement member to the opposite side with respect to the hammer body to separate the projecting piece of the hammer body from the engaging stepped portion in accordance with a striking pivotal movement of the hammer body, the projecting piece of the hammer body can be forced to be separated from the engaging stepped portion of the escapement member. Therefore, since a member such as the supporting pole 375 for increasing a shifting component in the horizontal direction (the direction toward keyboard portion) of the beak-like projecting piece 379 as conventionally required is unnecessary or made smaller, and the length of the keyboard body can be designed short, the height of the action mechanism can be designed extremely low and the depth extremely shallow.

Moreover, a keyboard musical instrument in accordance with another invention has a keyboard portion in one end and is held at the middle part in the longitudinal direction to be made swingable; a hammer body having a hammer portion for striking that is pivotally fixed at its base in the opposite side of the keyboard portion across the swinging central point of the keyboard body and; an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and integrally forms in the escapement member a control member separably opposing the hammer body in the striking direction for separating the hammer body from the sound source body and stopping it in the state in which the beak-like projecting piece is let off from the engaging stepped portion.

In this way, since the control member is integrally formed in the escapement member for separably opposing the hammer in the striking direction and separating the hammer body from the sound source body to stop it in the state in which the beak-like projecting piece is separated from the engaging stepped portion, the back-check 389 as required in the conventional art becomes unnecessary and the number of components and the number of assembly steps can be reduced. In addition, the height of the action mechanism portion may be made low. Further, the present invention can also be applied to a jumping-up style keyboard musical instrument with the conventional structure.

In addition, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and a fixed member fixed in a base for holding the keyboard body is provided with a control member separably opposing the hammer portion of the hammer body in the striking direction of the abutting the base end, separating the hammer body from the sound source body and stopping it in the state in which the projecting piece is let off from the engaging stepped portion.

In this way, since the control member is provided in the fixed member and moreover is abutting the base end of the hammer body, the escapement member can be simplified and the control member can be smaller. Further, the present invention can also be applied to a jumping-up style musical instrument with the conventional structure.

In addition, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body, when the pivotal fulcrum of the hammer body pivots in the striking direction by a key striking operation of the keyboard portion, and a pushing out member for pushing out the escapement member to the opposite side with respect to the hammer body to separate the projecting piece of the hammer body from the engaging stepped portion is formed in a shape projecting toward the sound source side with respect to an extended line of the arm portion of the hammer body.

In this way, since the pushing out member projects toward the string side with respect to an extended line of the arm portion of the hammer body, even in a case where the arm portion of the hammer body is formed short, the escapement member is not made small but can be designed in a sufficient size to perform an accurate operation, and can have durability. Moreover, since the pivotal fulcrum of the hammer body can be designed lower with respect to the pushing out member, the entire keyboard musical instrument can be made more flat. Further, the present invention can also be applied to a jumping-up style musical instrument with the conventional structure.

Further, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and a recessed portion is provided in the sound source body direction side of the engaging stepped portion of the escapement member, an operation block is provided as if getting into the recessed portion, and an elastic member for always biasing the escapement member toward the sound source body direction is provided in the opposite side with respect to the sound source body direction of the escapement member.

In this way, since the operation block is provided as if getting into the recessed portion of the escapement member, and the elastic member for always biasing the escapement member in the sound source body direction is provided in the opposite side with respect to the sound source body direction of the escapement member, even if the keyboard musical instrument is played while being held in the player's arms (played while the player is standing), the hammer body does not become unsteady, and hence the hammer body never strikes the sound source body inadvertently. In addition, the lower surface of the recessed portion may be made to function as a control member, in which case it is more preferable in regards to repeated striking. Further, the present invention can also be applied to a jumping-up style musical instrument with the conventional structure.

In addition, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body and; an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and an elastic member for biasing the keyboard body to the opposite side with respect to the sound source body direction is provided. Therefore, the keyboard body never rises in any positional state, and standing play and the like are made possible. Further, the present invention can also be applied to a jumping-up style musical instrument with the conventional structure.

In addition, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and an engaging stepped portion for engaging the projecting piece that is mounted in the escapement member, and the keyboard musical instrument is further configured such that the projecting piece of the hammer body and the engaging stepped portion of the escapement member are engaged and the hammer body performs a striking pivotal operation against the sound source body, when the pivotal fulcrum of the hammer body pivots in the striking direction by a key striking operation of the keyboard portion, and a structure for pivotally fixing the hammer body is provided with holes in the keyboard body and the base of the hammer body respectively, a screw union having a female screw inside is put in the holes, and screw union having a male screw is incorporated from the surface opposite the surface on which the hammer body abuts the keyboard body such that the screw union engages with the female screw.

With this structure, pivoting of the hammer body is made smooth and sound striking operation is also made smooth. Further, the present invention can also be applied to a jumping-up style musical instrument with the conventional structure.

Moreover, a keyboard musical instrument in accordance with another invention has a keyboard body having a keyboard portion in one end and is held at the middle part in the longitudinal direction to be made swingable; a hammer body having a hammer portion for striking that is pivotally fixed at its base in the opposite side of the keyboard portion across the swinging central point of the keyboard body; and an escapement member always biased toward the hammer body, and is provided with a projecting piece in the opposite side of the hammer portion across the pivotal fulcrum of the hammer body; and is provided with an engaging stepped portion for engaging the projecting piece mounted in the escapement member, and the keyboard musical instrument is further configured such that the projecting piece of the hammer body and the engaging stepped portion of the escapement member are engaged and the hammer body performs a striking pivotal operation against the sound source body when the pivotal fulcrum of the hammer body pivots in the striking direction by a key striking operation of the keyboard portion, and the escapement member is disposed in the keyboard portion side with respect to the pivotal fulcrum that fixed the hammer body and the keyboard portion.

In accordance with this invention, since either of the hammer body or the escapement member is disposed in the keyboard portion side with respect to the striking point of the hammer portion of the hammer body, the hammer body and the escapement member never project to the opposite side with respect to the keyboard portion. Therefore, the depth of the entire keyboard musical instrument can be designed small by appropriately employing the configuration of the present invention in accordance with the arrangement of a sound source body such as a string.

BEST MODE FOR CARRYING OUT THE INVENTION

Figure 1:
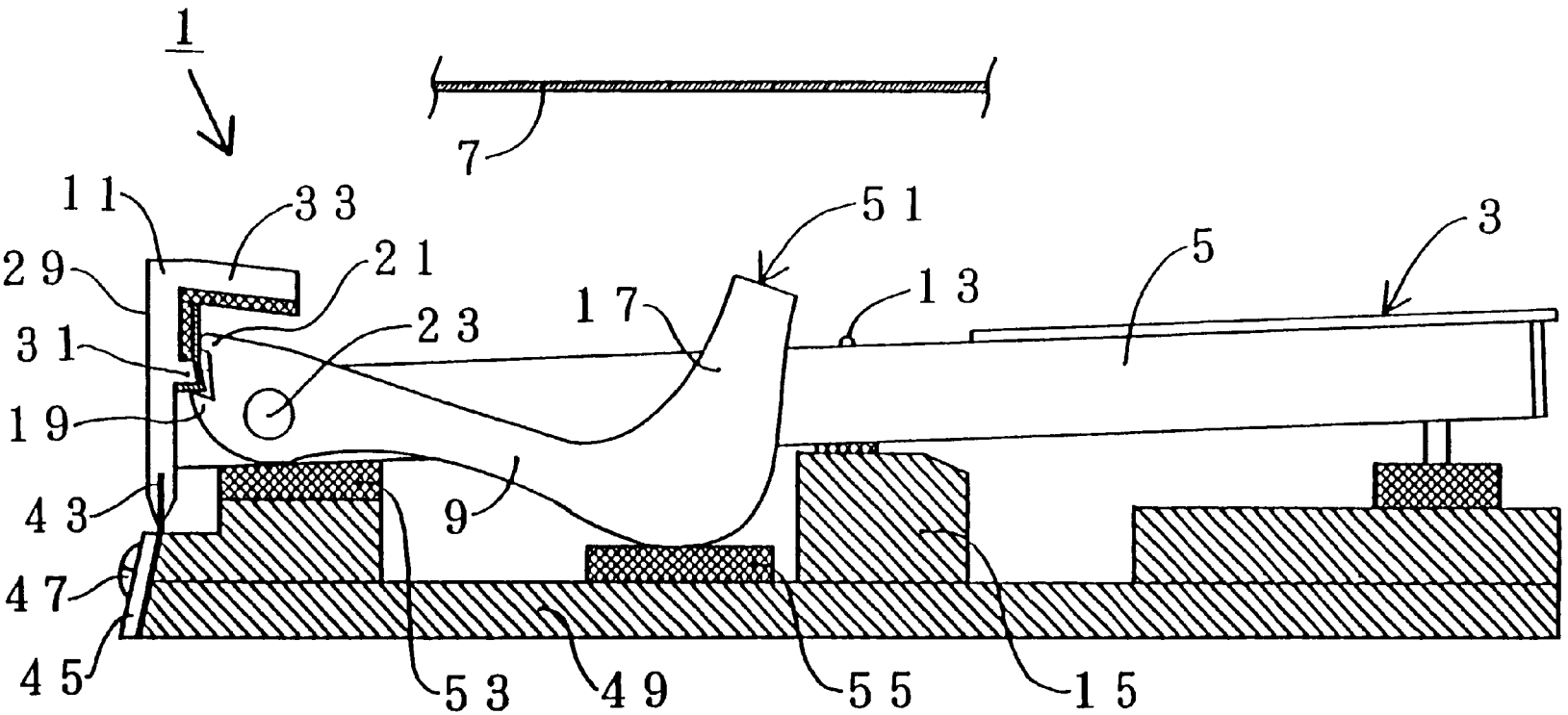
FIG. 1 is a side view illustrating an action mechanism used in a keyboard musical instrument of a first embodiment of the present invention.

Preferred embodiments of the present invention will be hereinafter described with reference to the figures. Further, a first embodiment of the present invention will be described first based on FIGS. 1 through 6. As shown in FIG. 1, an action mechanism 1 of a keyboard musical instrument in accordance with the first embodiment of the present invention consists of a keyboard body 5 having a keyboard portion 3 in its right side (in the figure), a hammer body 9 for striking a string 7 that is a sound source body, and an escapement member 11 for controlling the striking pivotal operation of the hammer body 9.

In FIG. 1, the middle part in the longitudinal direction of the keyboard body 5 having the keyboard portion 3 at its right side end (in the figure) is swingably held by a pin 13 on the upper surface of a pedestal 15. A hole 5*a* is made in the opposite side of the keyboard body 5 across a swinging fulcrum (the position of the pin 13 that is also a holding point) as shown in FIG. 2.

The hammer body 9 has a hammer portion 17 that should strike the string 7 (see FIG. 1) at its top end. A hole 9*a* is made in the base of the hammer body 9, and a beak-like projecting piece 19 to be a projecting piece is protrudingly provided in the opposite side of the hammer portion 17 across the hole 9*a*. In addition, a pushing-out protrusion 21 that is a pushing-out member in the present invention is protrudingly provided in the upper side with respect to the beak-like projecting piece 19.

Figure 2:
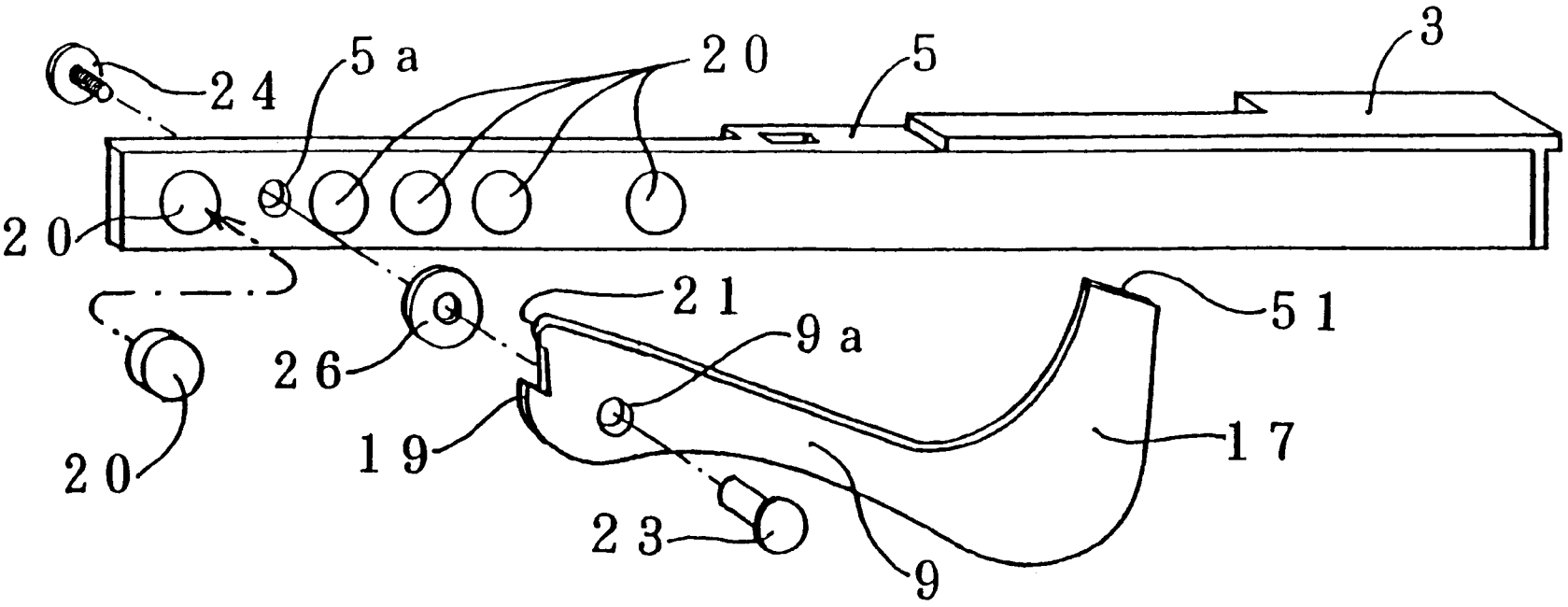
FIG. 2 is a perspective view illustrating a keyboard body and a hammer body in the action mechanism of FIG. 1.

As shown in FIG. 2, the keyboard body 5 and the hammer body 9 are relatively and pivotally fixed by inserting into the hole 5*a* of the keyboard body 5 and the hole 9*a* of the hammer body 9 through a washer 26, and tightening a screw union 23 having a female screw inside and a screw union 24 having a male screw on the circumference. Further, the inner diameter of the hole 9*a* of the hammer body 9 is slightly larger than the outer diameter of the screw union 23 in the female side (outer side), hence, the hole 9*a* is made rotatable with respect to the screw union 23 in the female side. A key lead 20 for adjusting the weight balance of the keyboard body 5 is provided on the side surface of the keyboard body 5. An appropriate number of key leads 20 are inserted in holes made in the keyboard body 5, and are fixed by beating from both sides in the compressing direction to enlarge the diameters. Further, the screw union 23 is made a pivotal fulcrum of the hammer body 9.

Figure 3:
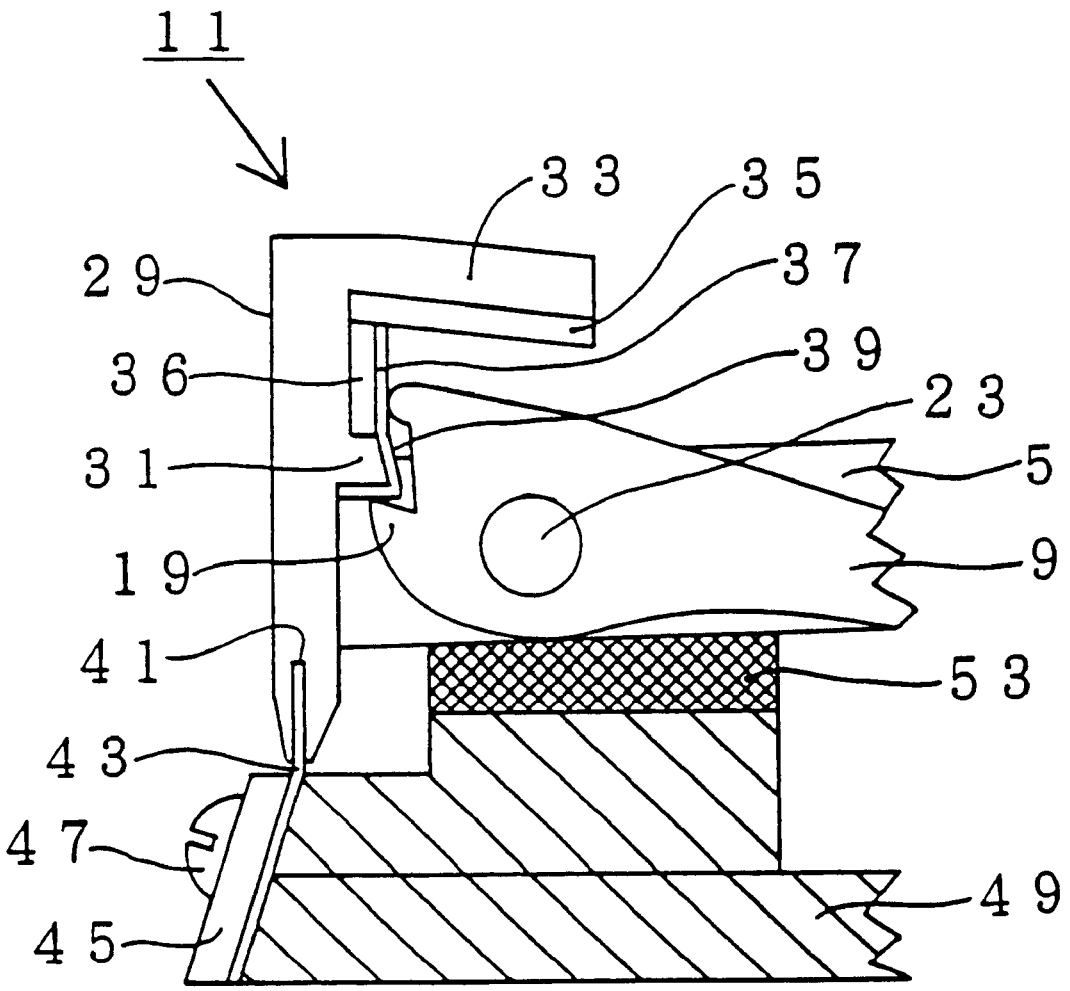
FIG. 3 is a side view illustrating a main part of the action mechanism of FIG. 1.

As shown in FIG. 3, the escapement member 11 is protrudingly provided with an engaging stepped portion 31 in the central inside of a back portion piece 29, and a control member 33 in the upper end of the back portion piece 29 respectively. In addition, cushions 35 and 36 made of cloth or felt are respectively stuck to the lower surface of the control member 33 and the upper side of the engaging stepped portion 31 (in the figure). Moreover, a sliding member 37 made of an uncut leather is stuck to the lower surface and the protruding surface of the engaging stepped portion 31 and the front surface of the cushion 36, which forms a return sliding surface 39 connecting the upper side (in the figure), with respect to the engaging stepped portion 31 of the back portion piece 29, and the right side top of the engaging stepped portion 31 (in the figure).

A groove 41 is provided in the lower end of the escapement member 11, and the top end of a spring plate 43 made of carbon fiber is inserted in and is adhered to the groove 41. The lower end of the spring plate 43 is fixed to a machine base 49 by a screw 47 via a stopping plate 45. In this way, the escapement member 11 is always biased toward the base of the hammer body 9 by the elasticity of the spring plate 43.

On the machine base 49, cushions 53 and 55 made of cloth are respectively laid in the position opposing the hammer portion 17 and the base (the position of the screw union 23) of the hammer body 9 as shown in FIG. 1.

Operations of the action mechanism 1 used in the keyboard musical instrument of the first embodiment will now be described. In FIG. 1, when a performer strikes keys of the keyboard portion 3, the keyboard body 5 pivots clockwise (in FIG. 1) around the pin 13 and the pedestal 15, and the pivot portion (the position of the screw union 23 and the rotational fulcrum of the hammer body 9) rises toward the striking direction, i.e., toward the string 7 side. With this rising, the beak-like projecting piece 19 of the hammer body 9 engages with the engaging stepped portion 31 of the escapement member 11.

Figure 4:
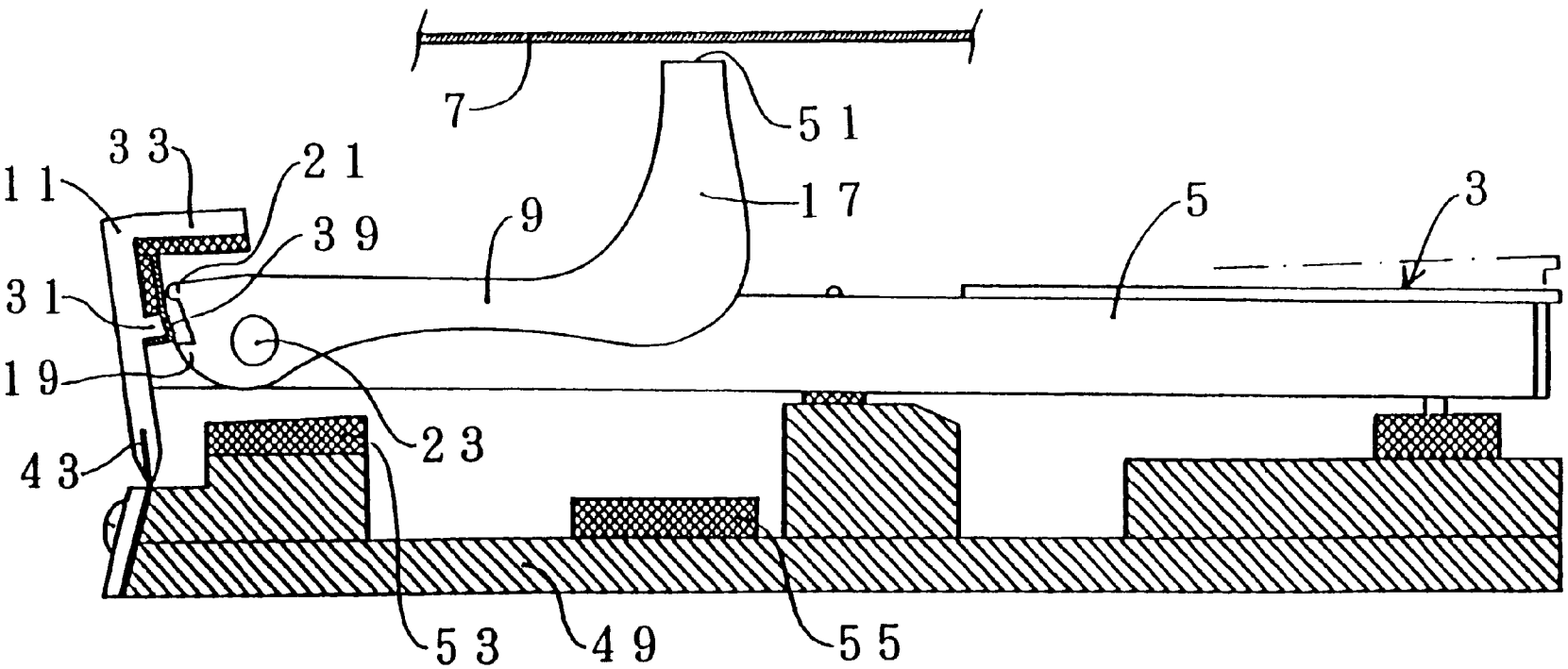
FIG. 4 is a side view illustrating the state immediately before striking a string in the action mechanism of FIG. 1.

When the performer further depresses the keyboard portion 3, as shown in FIG. 4, the pivot portion (the position of the screw union 23) of the hammer body 9 further rises toward the string 7. On the other hand, since the shift of the beak-like projecting piece 19 is prevented by the engaging stepped portion 31, the hammer portion 17 side of the hammer body 9 pivots to perform a striking pivot operation against the string 7. At this time, the pushing-out protrusion 21 of the hammer body 9 gradually pushes out the escapement member 11 to its back side (the left side in FIG. 4) against the elasticity of the spring plate 43 while contacting the return sliding surface 39 of the escapement member 11.

Figure 5:
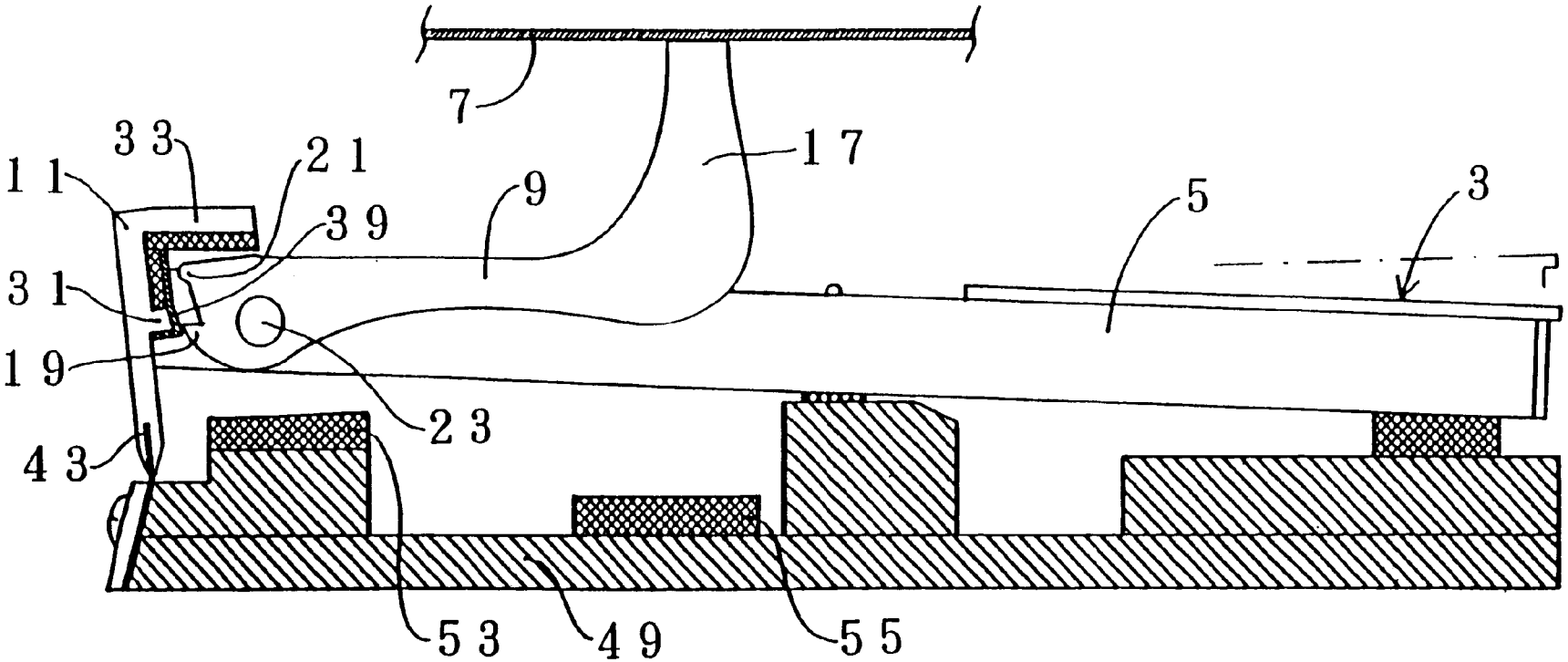
FIG. 5 is a side view illustrating the state at the time of striking a string in the action mechanism of FIG. 1.

Then, the hammer portion 17 of the hammer body 9 strikes the string 7. Immediately before striking, the escapement member 11 is pushed out completely to its back side against the elasticity of the spring plate 43 by the pushing-out protrusion 21 of the hammer body 9, which let off the beak-like projecting piece 19 of the hammer body 9 from the lower surface of the engaging stepped portion 31. As shown in FIG. 5, when the hammer portion 17 of the hammer body 9 strikes, the beak-like projecting piece 19 is positioned more upward than the lower surface of the engaging stepped portion 31 of the escapement member 11 (in the figure). Therefore, when the escapement member 11 is returned from its retreated position by the elasticity of the spring plate 43, the beak-like projecting piece 19 let off from the engaging stepped portion 31 abuts the return sliding surface 39 that is above the lower surface of the engaging stepped portion 31.

Then, after the beak-like projecting piece 19 of the hammer body 9 is let off from the lower surface of the engaging stepped portion 31, the hammer body 9 continues the rotational motion by inertia, and the hammer portion 17 strikes the string 7. Meanwhile, the keyboard portion 3 is depressed by the performer (see FIG. 5). The hammer portion 17 after striking the string 7 is forced back to the lower side (in the figure) by the repulsion of the string 7, which makes the hammer body 9 rotate counter clockwise (clockwise in the figure).

Figure 6:
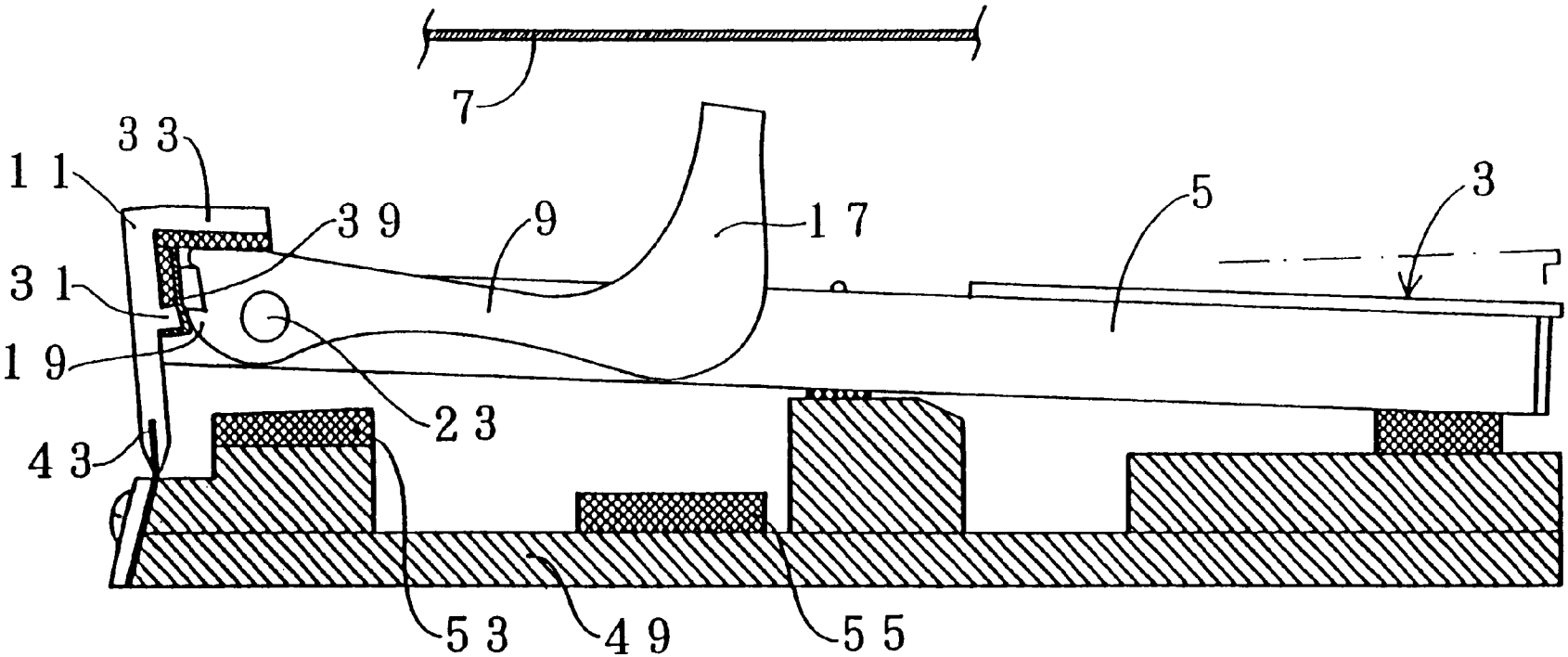
FIG. 6 is a side view illustrating the state in which the hammer body is stopped by a control member after striking the string in the action mechanism of FIG. 1.

Here, the control member 33 of the escapement member 11 abuts the upper surface of the base end of the hammer body 9, which stops the hammer body 9 at the position where the hammer portion 17 is separated from the string 7 (FIG. 6). That is, the lower surface of the control member 33 adheres to the upper surface of the base end of the hammer body 9 by the pressing-down force of the keyboard portion 3 and the control of the control member 33 and is prevented from pivoting clockwise (in the figure) of the hammer body 9, and at the same time, is also prevented from pivoting counter clockwise (in the figure) of the hammer body 9 by the repulsion of the collision of the lower surface of this control member 33 and the hammer body 9. In this way, since the pivoting of the hammer portion 17 is stopped by the control member 33, the hammer body 9 does not strike the string 7 again by rebounding.

Finally, when the performer releases the keyboard portion 3, the opposite side end of the keyboard body 5 falls while the keyboard portion 3 rises, which causes the beak-like projecting piece 19 to slide along the return sliding surface 39 and to return to under the engaging stepped portion 31. On the other hand, the hammer body 9 is then released from the control by the control member 33, drops to the cushion 55 due to it own weight, and returns to the state shown in FIG. 1.

In this way, in the first embodiment of the present invention, since the pushing-out protrusion 21 is provided in the base end of the hammer body 9, which is to be a pushing-out member for letting off the beak-like projecting piece 19 of the hammer body 9 from the engaging stepped portion 31 by pushing out the escapement member 11 to the opposite side with respect to the hammer body 9 with the striking pivotal operation of the hammer body 9, the beak-like projecting piece 19 of the hammer body 9 can be forced to be let off from the engaging stepped portion 31 of the escapement member 11. Therefore, since a member such as the supporting pole 375 for increasing a shifting component in the horizontal direction (the direction toward keyboard portion) of the beak-like projecting piece 379 as required in conventional examples is unnecessary or can be made small, the length of the keyboard body 5 can be designed short, the height of the action mechanism 1 can be designed extremely low and the depth extremely shallow.

In addition, in the first embodiment, since the control member 33 is integrally formed in the escapement member 11 for separably opposing the hammer body 9 in the striking direction and separating the hammer body 9 from the string 7 to stop in the state in which the beak-like projecting piece 19 is separated from the engaging stepped portion 31, the back-check 389 as required in the conventional examples become unnecessary and the number of components and the number of assembly steps can be reduced. In addition, since the bulky back-check 389 becomes unnecessary, the height of the action mechanism 1 portion can be made low.

Further, the first embodiment has the configuration in which the pushing-out protrusion 21 to be a pushing out member is provided in the base end of the hammer body 9, however, a pushing-out member in accordance with the present invention may be provided in the escapement member 11 side instead of the hammer body 9 side.

Figure 7:
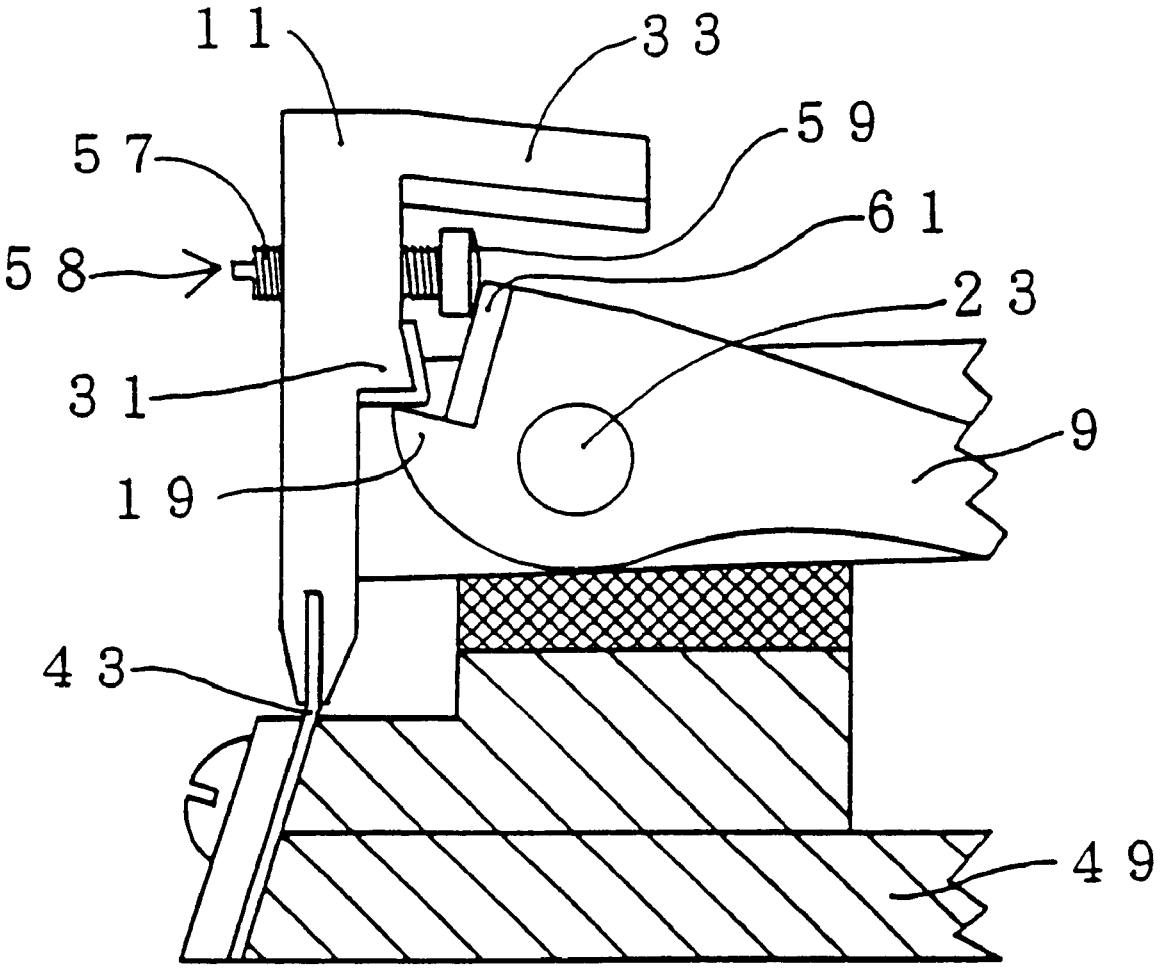
FIG. 7 illustrates a second embodiment of the present invention and is a side view illustrating a main part of a modified portion of the action mechanism of the first embodiment.

Moreover, as in a second embodiment of the present invention shown in FIG. 7, another configuration may be employed in which an adjustment screw 57 is attached to an escapement member 11 in the manner the adjustment screw 57 can protrude and move backward by the rotational operation of the escapement member 11, which adjusts the space between the escapement member 11 and the cushion 61 provided in the hammer body 9 side. In this case, there is an advantage that a beak-like projecting piece 19 of the hammer body 9 can be forced to be let off from an engaging stepped portion 31 of the escapement member 11 by the abutment of a head 59 of the adjustment screw 57 and the cushion 61 provided in the hammer body 9 side. In addition, there is another advantage that the timing for letting off the beak-like projecting piece 19 and the engaging stepped portion 31 can be adjusted exactly by rotating the adjustment screw 57 utilizing a flat gripping portion 58 to protrude or move backward.

Figure 8:
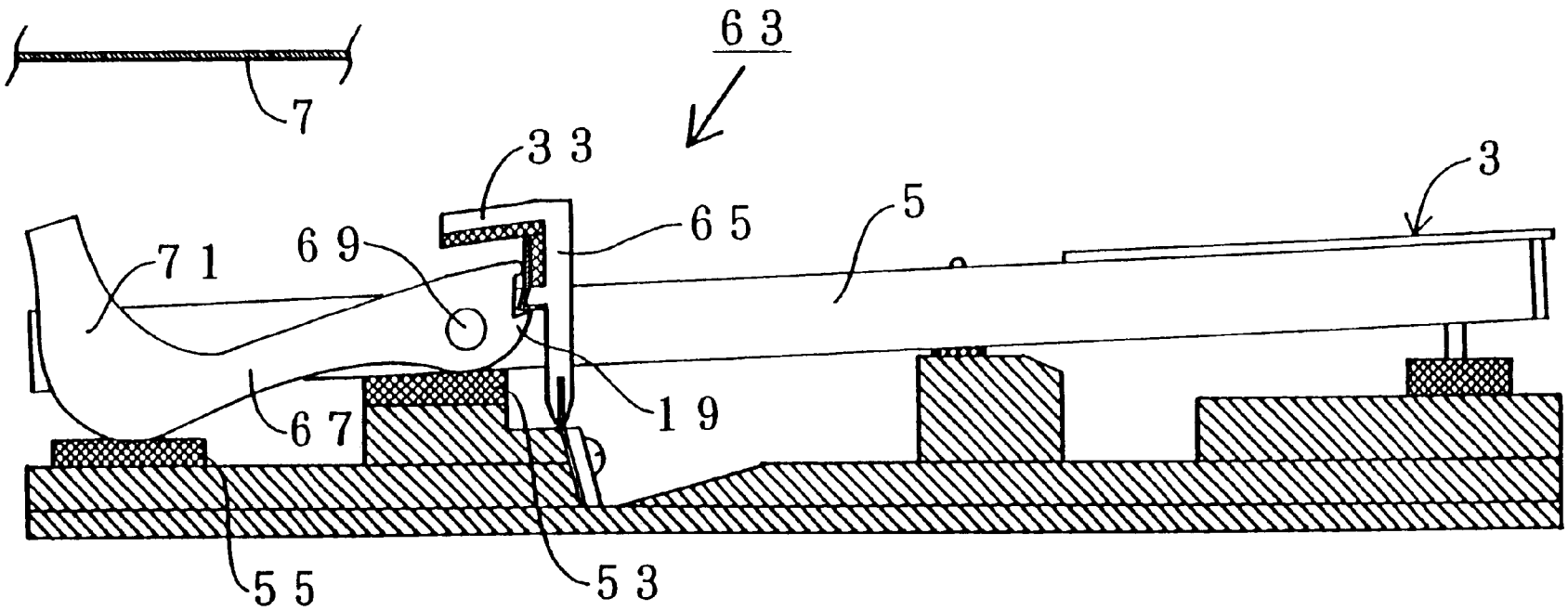
FIG. 8 is a side view illustrating an action mechanism used in a keyboard musical instrument of a third embodiment of the present invention.

A third embodiment of the present invention will now be described with reference to FIG. 8. In an action mechanism 63 of the third embodiment, an escapement member 65 is disposed in a keyboard portion 3 side view from a screw union 69 (an illustration of the other screw union is omitted) used for pivotally fixing a hammer body 67. Further, since a configuration of other parts of the action mechanism 63 of the third embodiment is the same as that of the action mechanism 1 of the first embodiment, its description is omitted.

Figure 9:
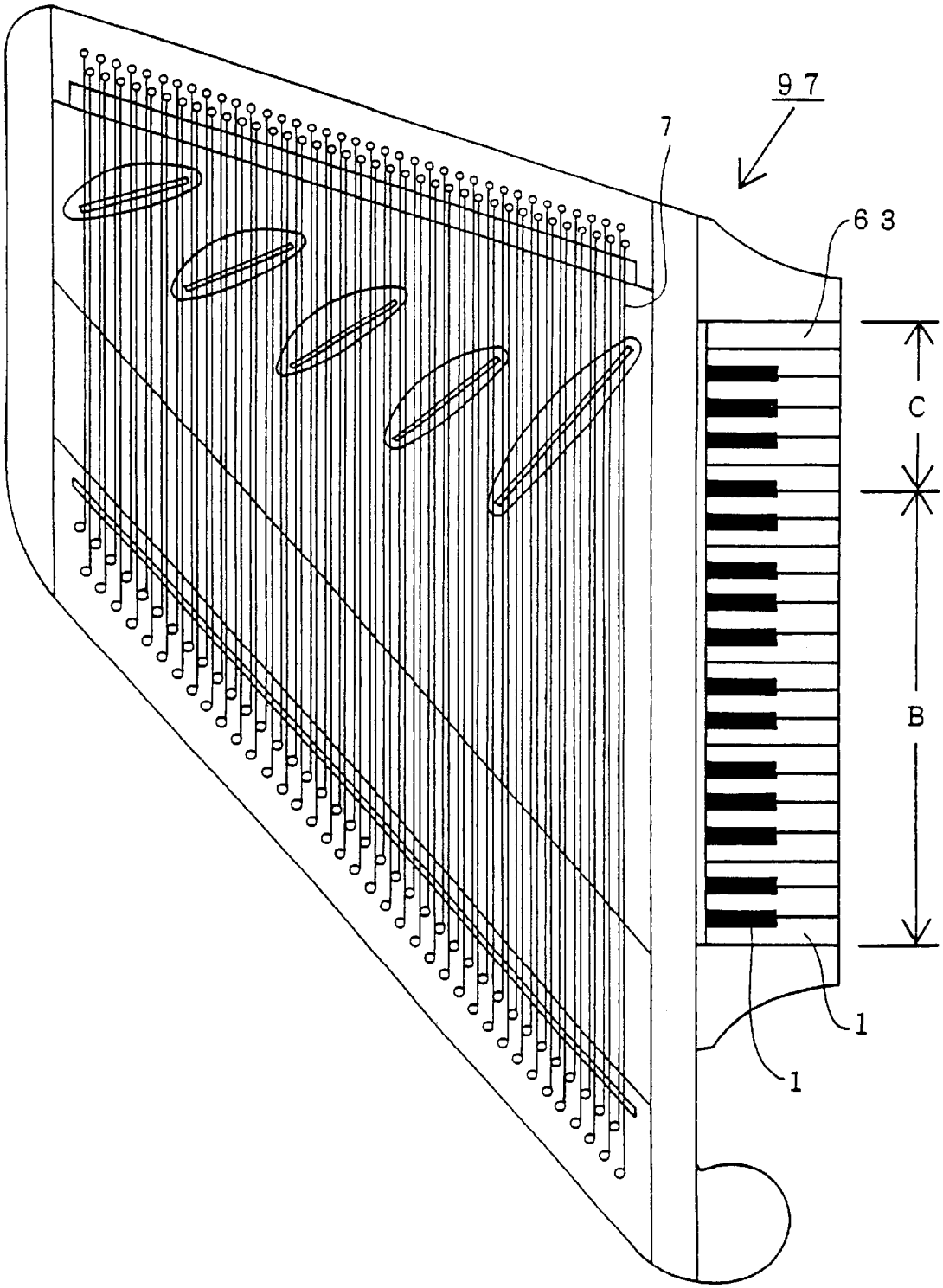
FIG. 9 is a plan view illustrating a keyboard musical instrument employing the respective action mechanisms of the first through the third embodiments of the present invention.

In accordance with this action mechanism 63, since both the hammer body 67 and the escapement member 65 are disposed in the keyboard portion 3 side with respect to a striking point of a hammer portion 71 of the hammer body 67, the hammer body 67 and the escapement member 65 does not protrude to the opposite side of the keyboard portion 3 with respect to the striking point of the hammer portion 71. Therefore, as shown in FIG. 9, in the case of a keyboard musical instrument 97 whose keyboard bodies 5 are serially getting longer from a bass part to a treble part, there is an advantage that the depth of the entire keyboard musical instrument 97 can be designed small by applying, for example, the action mechanism 1 of the first embodiment to keyboards in a bass range (B in the figure) and the action mechanism 63 of the third embodiment to keyboard in a treble range (C in the figure) respectively, depending on the arrangement of strings 7.

Figure 10:
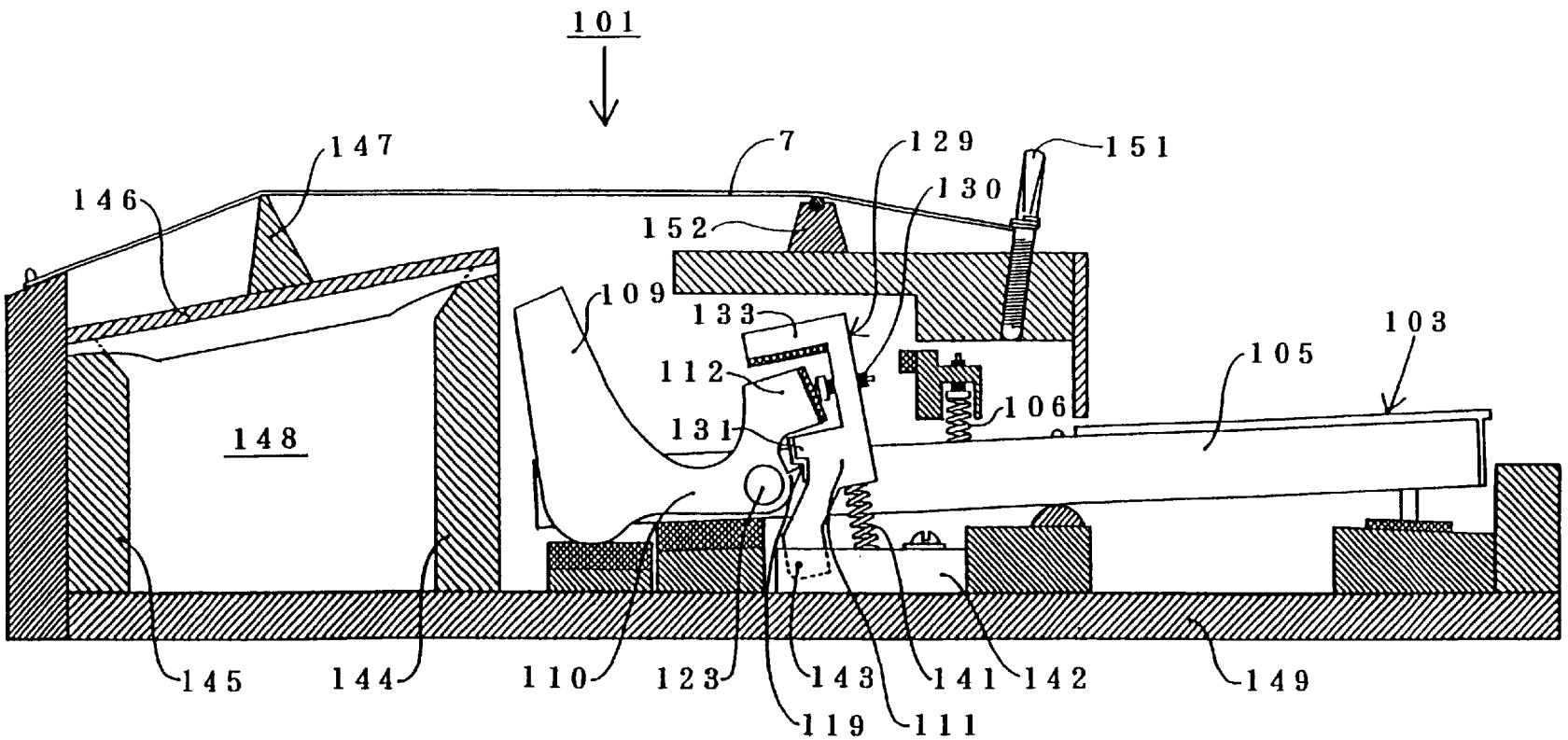
FIG. 10 is a side view illustrating an action mechanism used in a keyboard musical instrument of a fourth embodiment of the present invention.

A fourth embodiment of the present invention will now be described. As shown in FIG. 10, an action mechanism 101 in a keyboard musical instrument of the fourth embodiment has an escapement member 111 disposed on the a keyboard portion 103 side with respect to a screw union 123 (an illustration of the other screw union is omitted) for pivotally attaching a hammer body 109, and has something in common with the third embodiment in this regard. However, the action mechanism 101 is made smaller and made to enable a playing state as in playing an accordion, i.e., to enable a standing play.

The hammer body 109 in the fourth embodiment has an arm portion 110 formed relatively short, and a beak-like projecting piece 119 to be a projecting piece and an operation block 112 to be a pushing-out member projecting toward the upper side (a string 7 side) with respect to an extended line of the arm portion 110 respectively formed in its base end (its right end in FIG. 10). On the other hand, an escapement member 111 is provided with a recessed portion and has an engaging stepped portion 131 formed below the recessed portion and a control member 133 formed in the inside upper part of the recessed part respectively, and screws an adjustment screw 130 in a back portion piece 129 of the escapement member 111. The lower end of the escapement member 111 is swingably fixed to a mounting base 142 by a shaft 143 and, at the same time, a coil spring 141 is mounted in a keyboard portion 103 side (the right side in FIG. 10) of the escapement member 111, which always biases the escapement member 111 toward the base end of the hammer body 109. On the other hand, a coil spring 106 is mounted on the upper surface of the keyboard body 105, which always biases the keyboard body 105 downward.

In addition, although the hammer body 109 is relatively and pivotally attached to the keyboard body 105 by a screw union 123, preferably, a thrust bearing (not shown) is mounted between the hammer body 109 and the keyboard body 105 instead of the washer 26 shown in FIG. 2, for the purpose of reducing sliding friction between them.

Frames 144 and 145 are provided on a machine base 149, a resonance plate 146 is mounted in the upper end of these frames 144 and 145, and a bridge 147 of a triangular prism shape is fixed in substantially the center of the resonance plate 146. These machine base 149, the frames 144 and 145, and the resonance plate 146 form a resonance box 148. In addition, a tuning pin 151 for fixing one end of a string 7 as well as adjusting the stretching condition of the string 7, and a trapezoid bridge 152 are fixed in a fixed portion similar to that disposed above the machine base 149.

Figure 11A:
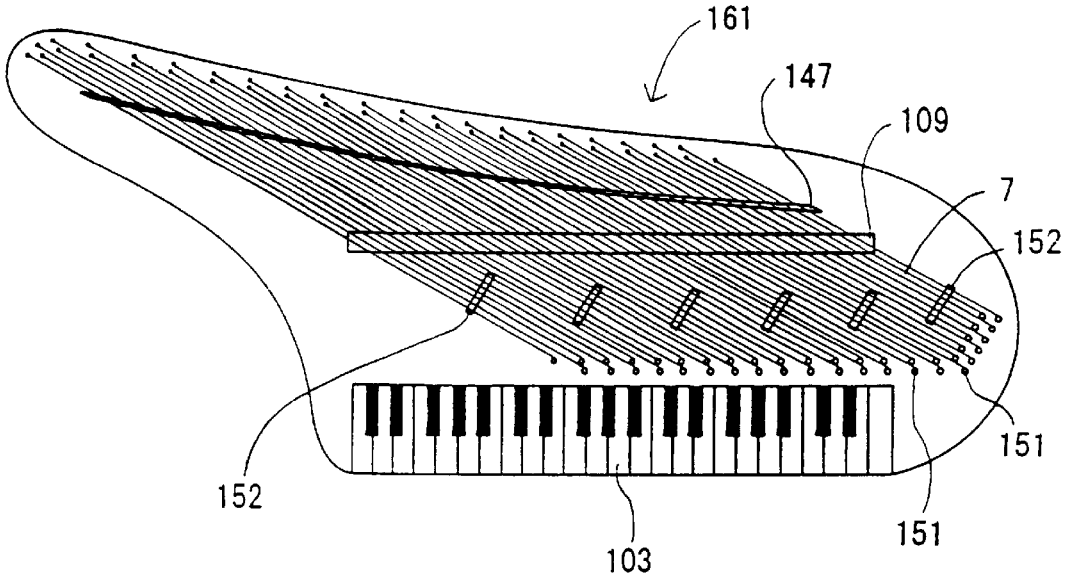
FIG. 11 is a plan view illustrating examples of two kinds of keyboard musical instruments employing the action mechanism of FIG. 10.
Figure 11B:
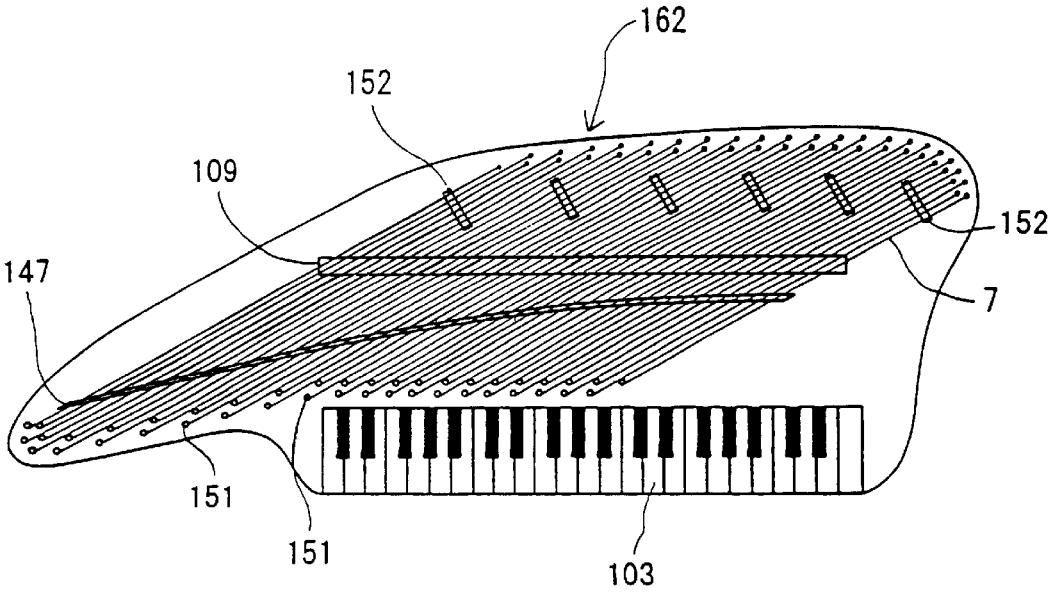

The string 7 may be stretched toward the left backend viewed from the front side (in the figure) (a performer side), as in a keyboard musical instrument 161 shown in FIG. 11(A), or may be stretched toward the right backend viewed from the performer side as in a keyboard musical instrument 162 shown in FIG. 11(B). Further, both the keyboard musical instruments 161 and 162 show an example in which the lengths of the keyboard bodies 105 are identical. In addition, the action mechanism 1 and the action mechanism 63 may be applied to the keyboard musical instruments 161 and 162.

Since the action mechanism 101 of the fourth embodiment has the operation block 112 to be a pushing-out member that protrudes toward the upper side (the string 7 side) with respect to an extended line of the arm portion 110 of the hammer body 109, even in a case the keyboard portion 105 and the arm portion 110 of the hammer body 109 are formed short, the escapement member 111 is not made small but can be designed in a sufficient size to perform an accurate operation, and further can have durability.

Moreover, since the mounting position of the screw union 123 can be designed lower in respect to the operation block 112, the entire keyboard musical instrument can be designed flat. In addition, in this embodiment, since the coil spring 141 is mounted under the escapement member 111 and the escapement member 111 is always biased toward the base end of the hammer body 109, it is not likely for the hammer body 109 to hit the string 7 inadvertently even if the keyboard musical instruments 161 and 162 are held with the bass range side (the left side in FIGS. 11(A) and (B)) at the top. In addition, since the thrust bearing is mounted between the hammer body 109 and the keyboard body 105, there is only a small friction between them. Moreover, since the keyboard body 105 is always biased downward by the coil spring 106, the keyboard portion 103 never rises. Therefore, a performer can play such a keyboard musical instrument by standing or sitting in a performing state such as in playing an accordion.

Figure 12:
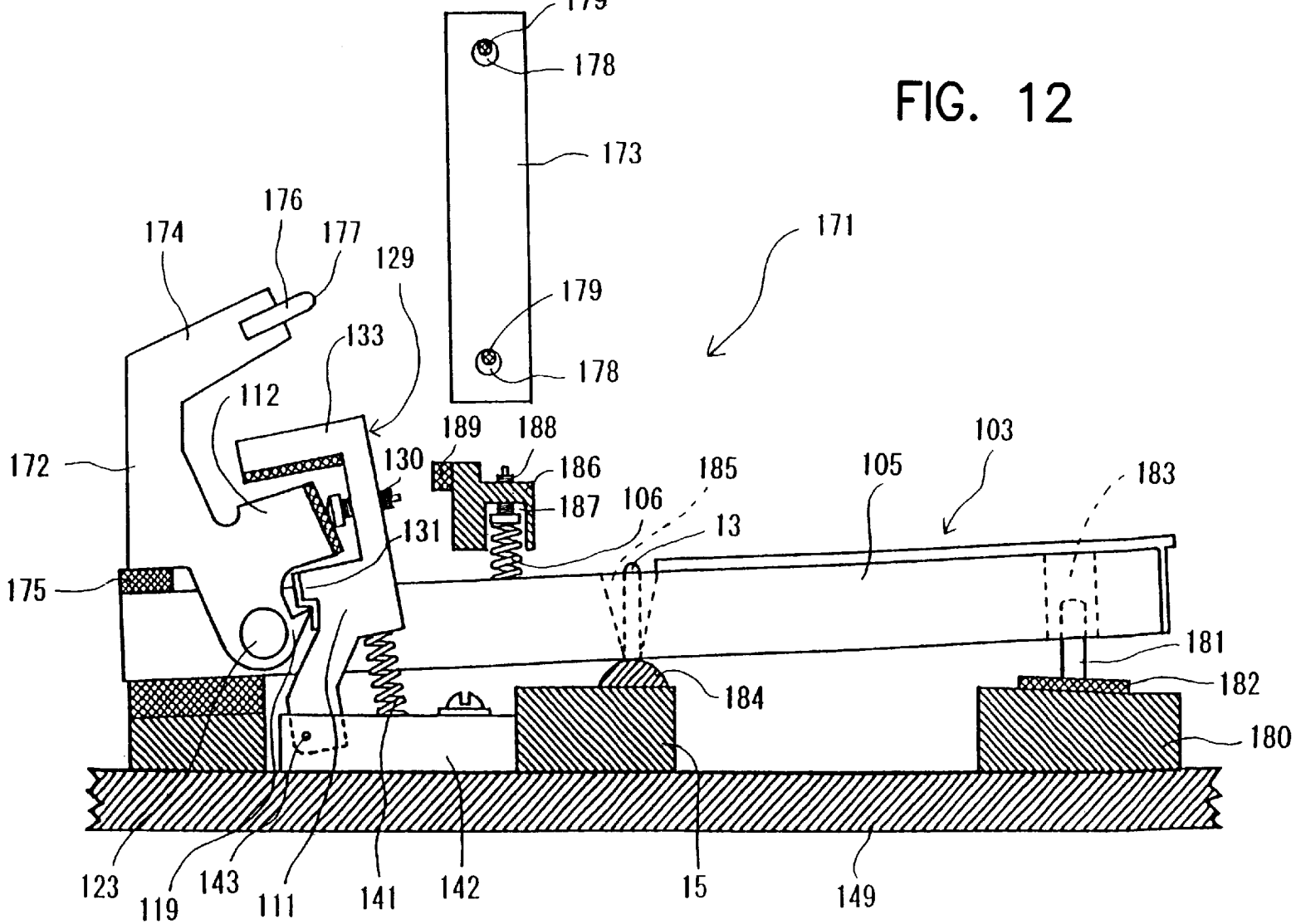
FIG. 12 is a side view illustrating an action mechanism used in a keyboard musical instrument of a fifth embodiment of the present invention.
Figure 13:
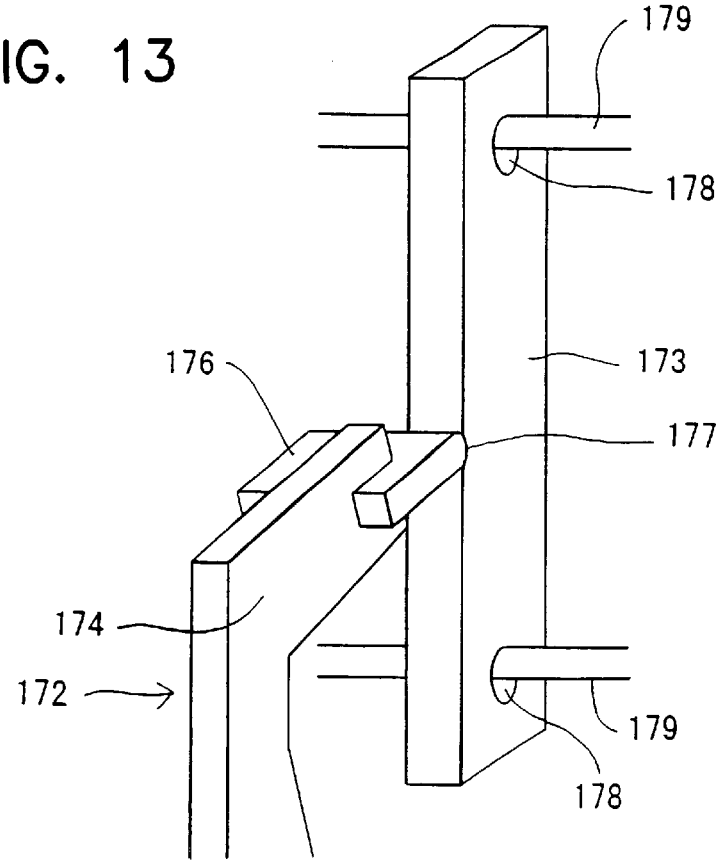
FIG. 13 is an enlarged perspective view of a hammer portion of a hammer body and a part of a sound source body of the action mechanism of FIG. 12.

A keyboard musical instrument of a fifth embodiment of the present invention will now be described based on FIGS. 12 through 14. The appearance of the keyboard musical instrument is a shape of an upright piano with an upper part of a keyboard taken off to be made smaller, but other appearances may be adopted. For example, an appearance identical with or similar to the keyboard musical instruments 97, 161 and 162 may be adopted. In this way, since various appearances can be selected and adopted, only an action mechanism 171 part in a keyboard musical instrument will hereinafter be described.

Since this action mechanism 171 has basically the same structure as that of the action mechanism 101, the same symbols are given to the same members and descriptions on the same members are omitted, and only the different main parts will be illustrated and described.

The action mechanism 171 has the escapement member 111 completely identical with that of the action mechanism 101, but has a hammer body 172 engaging the escapement member 111 different from the hammer body 109 of the action mechanism 101, and at the same time is different from the action mechanism 101 in that a sound generating body is a metal plate 173 disposed vertically instead of the string 7.

In the action mechanism 171, a cushion material 175 made of felt to which the lower end of a hammer portion 174 of the hammer body 172 abuts is disposed in the opposite side end of the keyboard portion 103 of the keyboard body 105. In addition, a striking sound generating portion 176 contacting the metal plate 173 provided in the top end of the hammer portion 174 such that the striking sound portion 176 is perpendicular to the metal plate 173 when striking sounds are generated. Further, the top end of the striking sound generating portion 176 is formed as a circular curved surface 177 as shown in FIG. 12, and striking sound generating portion of other shapes are made to be appropriately attachable to the hammer portion 174. The metal plate 173 is held by hanged supporting members 179 that are inserted and held in openings 178 in the upper and lower end sides of the metal plate 173.

Figure 14:
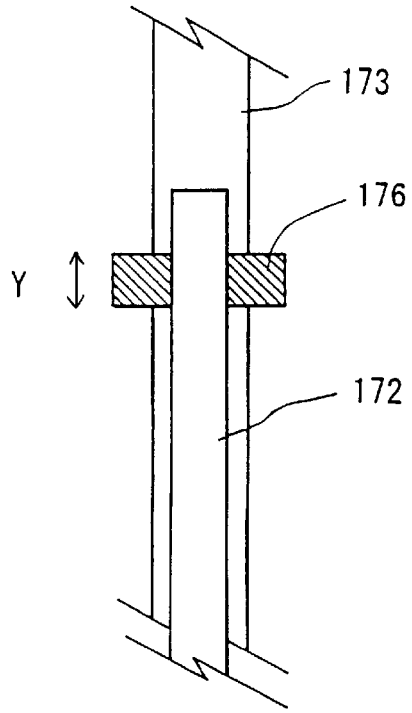
FIG. 14 is a view from the back of the hammer portion illustrating the hammer portion of the hammer body and the part of the sound source body of FIG. 12 overlapping each other.

In addition, the striking sound generating portion 176 may be stuck in an appropriate position by shifting the mounting position of the striking sound generating portion 176 as indicated by an arrow Y of FIG. 14. Further, in FIG. 14 although the metal plate 173 is hanged vertically, even if the metal plate 173 is disposed inclining, the striking sound generating portion 176 can be stuck inclined correspondingly. The configuration for sticking the striking sound generating portion 176 and enabling it to shift, can be also applied to the aforementioned first through fourth embodiments.

Under the keyboard portion 103, a pedestal 180 fixed on a machine base 149, a keyboard position regulating bar 181 having an oval-shaped cross section fixed on the pedestal 180, and a cushion portion 182 made of felt material and the like of disk-shape mounted on the pedestal 180 are provided. The keyboard position regulating bar 181 performs positional regulation in the latitudinal direction of the keyboard body 105 by entering a screw slot like groove 183 provided in the keyboard body 105. Further, the groove 183 is blocked by the keyboard portion 103 at its top end.

A semi-spherical shaped supporting portion 184 is provided on the pedestal 15, in the manner of crossing the keyboard body 103, in order to ease the swing of the keyboard body 103. Further, it is preferable to mount a cushion material made of felt and the like on this supporting portion 184. The pin 13 having the circular cross section is a hole provided in the keyboard body 105, and is configured to enter a fan-shaped hole 185 having longer longitudinal length toward the upper part and to be made swingable around the abutting part of the keyboard body 105 and the supporting portion 184 as a fulcrum.

One end side of the coil spring 106 enters a cavity 187 provided in a fixed portion 186 fixed on the machine base 149 and the other end abuts the keyboard body 105. The biasing force of the coil spring 106 is made to be adjusted by the adjustment screw 188. A cushion member 189 made of felt and the like is stuck and fixed on the fixed portion 186, which functions as a cushion when the back portion piece 129 of the escapement member 111 knocks against the fixed portion 186.

A sixth embodiment of the present invention will now be described. Only an action mechanism 201 will be described as well concerning this embodiment. The action mechanism 201 is considerably different from that of other embodiments in that a control member is formed in a fixed portion that is integral with the machine base 49, 149 whereas the previously shown control members 33 are 133 are integrally formed in the escapement members 11, 65 and 111. Further, since most of the other parts have the similar configurations as the action mechanism 101 of the fourth embodiment and the action mechanism 171 of the fifth embodiment, the same symbols are given to the same members and their descriptions are omitted or simplified.

The hammer body 202 has, other than the beak-like projecting piece 119 to be a projecting piece and the operation block 112 to be a pushing-out member, a hammer portion 203 for striking the string 7, a rear abutting portion 204 for contacting and separating from the cushion material 175, and a moving-over portion for repeated striking 205 mounted on the rear end (the left side in FIG. 15) of the operation block 112.

The escapement member 207 has a similar configuration as that of the escapement member 111 of the fourth and the fifth embodiment, but is different in that it does not have the control member 133. In this action mechanism 201, a fixing control portion 208 to be a control member is fixed to the fixed portion 186. In this fixing control portion 208, a cushion portion 209 made of felt and the like is provided in a part to which the upper surface of the operation block 112 of the hammer body 202 abuts. In addition, a rubber member 210 is attached to the rear end of the fixing control portion 208 by a bolt 212 and a nut 213 via an inserted member 211.

The pin 221 fixed on the pedestal 15 at it lower end is fixed at both ends by its upper end entering an upper side of the supporting portion 222 having the same shape as the supporting portion 184. The performer's side top end of the keyboard body 105 is a screw slot portion 223, and its opening portions in the upper side and the top end side and are blocked by the keyboard portion 103. In the rear end (the left end in FIG. 15) of the keyboard body 105, a spring abutting portion 224 with its upper side cut off is provided, and a coil spring 225 is disposed such that its one end abuts this spring abutting portion 224.

The other end of the coil spring 225 enters into and is held by a semi-spherical shaped cylinder portion 226 having a cavity inside. This cylinder portion 226 is formed integrally with an adjustment screw 228 attached to a fixed portion 227 fixed on the machine base 149, and is movable vertically by the pivoting of the adjustment screw 228.

One end of the coil spring 141 abutting the escapement member 207 enters the escapement member 207, and the other end having the same shape as the cylinder portion 226 enters into and is held by a cylinder portion 229 fixed on the mounting base 142. In addition, the bottom part of the cylinder portion 229 is made a screw and is movable vertically by pivoting.

A third pedestal 231 is also mounted and fixed on the machine base 149 other than the pedestals 15 and 180. A cushion member 232 is mounted and fixed on the pedestal 231 in the manner to cross the keyboard body 105. Further, the pedestal 180 is formed in a slope shape with the height being low in its front side and getting higher toward the inner side. On the other hand, the pedestal 231 has a shape making a slope in the direction opposite from that of the pedestal 180. That is, both the pedestals have a symmetrical shape with the supporting portion 184 as the center.

Figure 15:
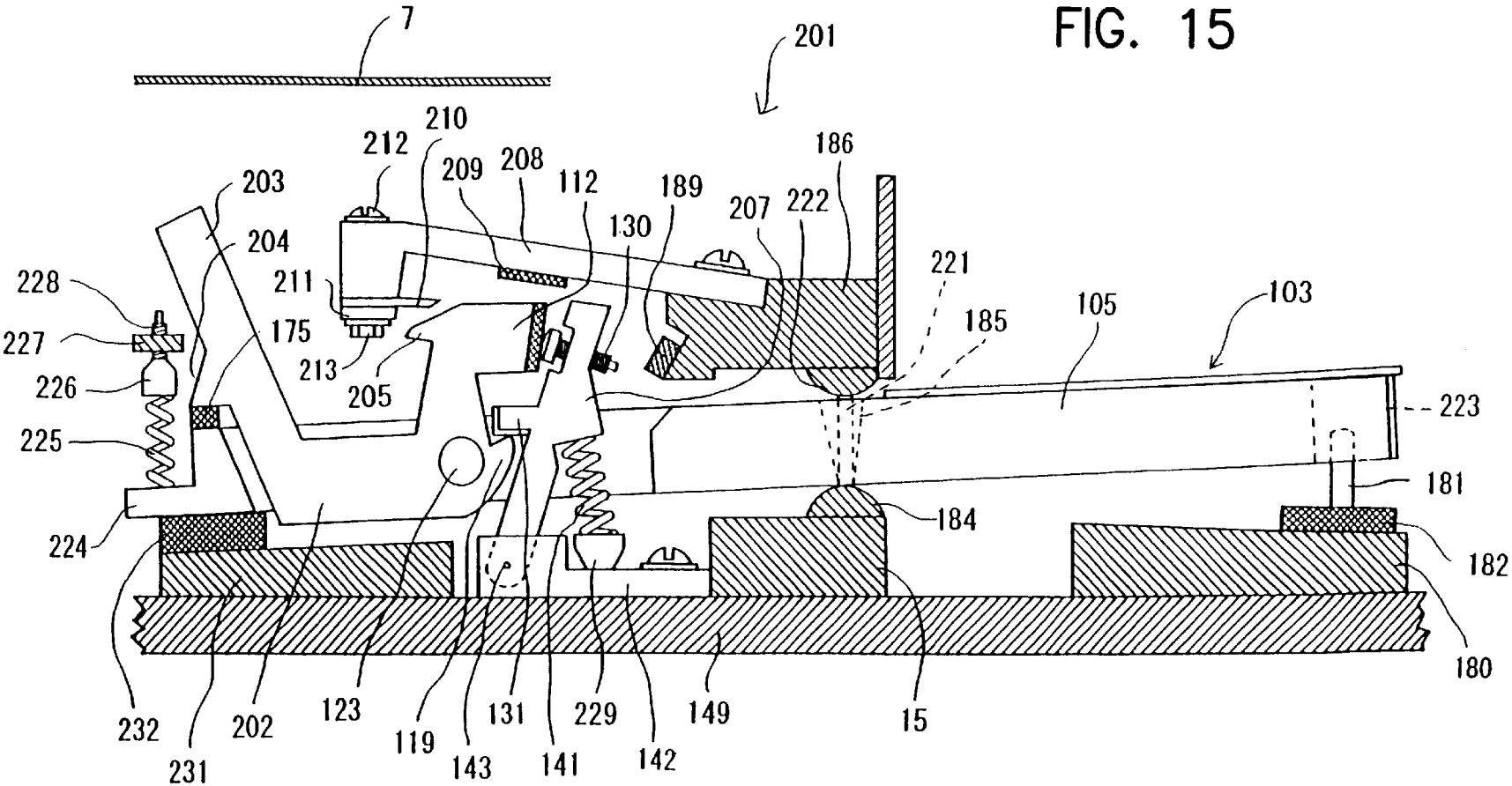
FIG. 15 is side view illustrating an action mechanism used in a keyboard musical instrument of a sixth embodiment of the present invention.
Figure 16:
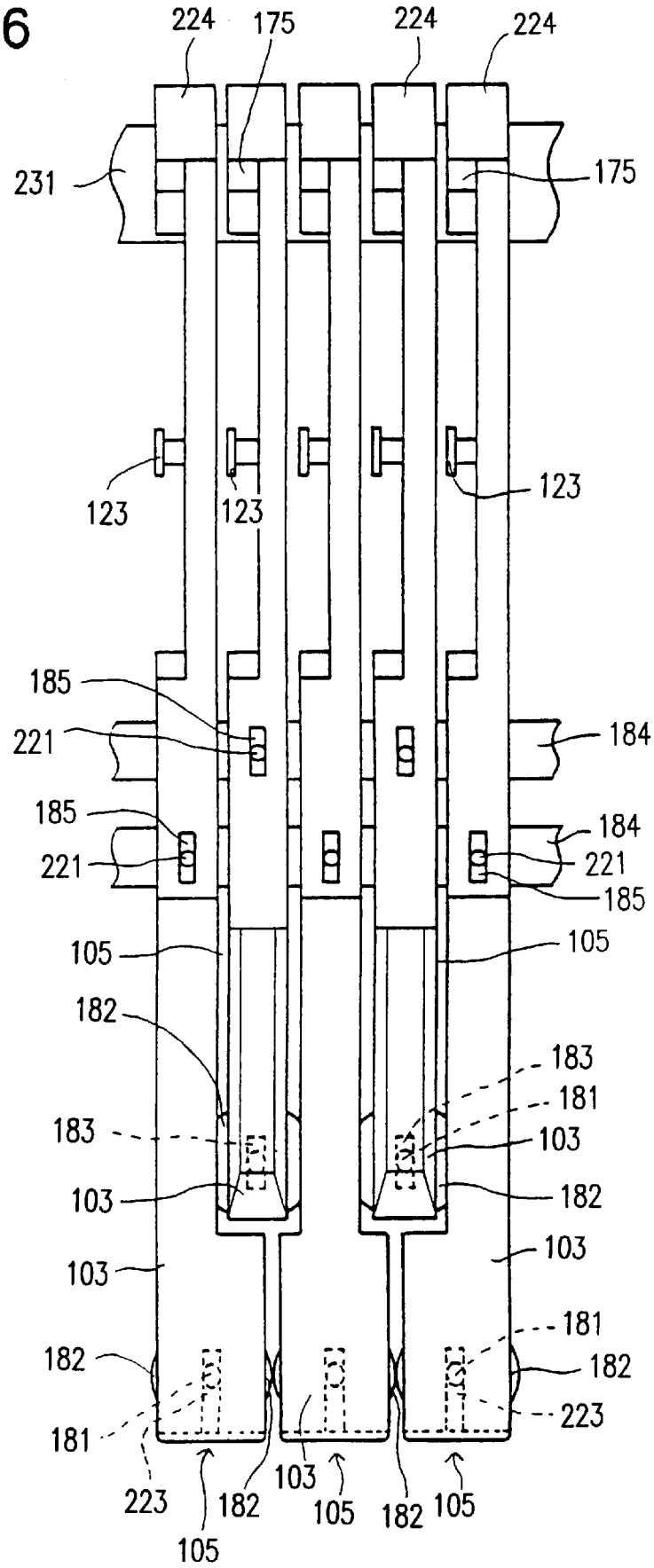
FIG. 16 is a plan view illustrating the state in which a member disposed over a keyboard body as well as a hammer body and an escapement member in the action mechanism of FIG. 15 are taken away.

A plan view of the state in which the fixed portion 186 and the like are disposed above the keyboard body 105 and the escapement member 207 are removed is shown in FIG. 16. FIG. 16 illustratively shows three tones of C, D and E as well as semitone parts between the tones. As shown in FIG. 16, the pins 221 to be swinging fulcrums of the keyboard bodies are arranged in two rows of an alternate arrangement due to the existence of the semitone parts, and the pins 181 of the keyboard portions 103 are also arranged in two rows of an alternate arrangement. Further, the shapes of the respective keyboard bodies 105 are different except that the shapes of two semitone parts are the same. However, the basic configuration of each keyboard body is completely identical with the configuration shown in FIG. 15.

Further, in other embodiments as well, for the keyboard bodies in which the positions of respective hammer bodies are the same with respect to the longitudinal direction, both the pins 13 and 221 to be the swinging fulcrums of the keyboard bodies and the pins 181 of the keyboard portions 3 and 103 are disposed in two rows of an alternate arrangement.

Figure 17:
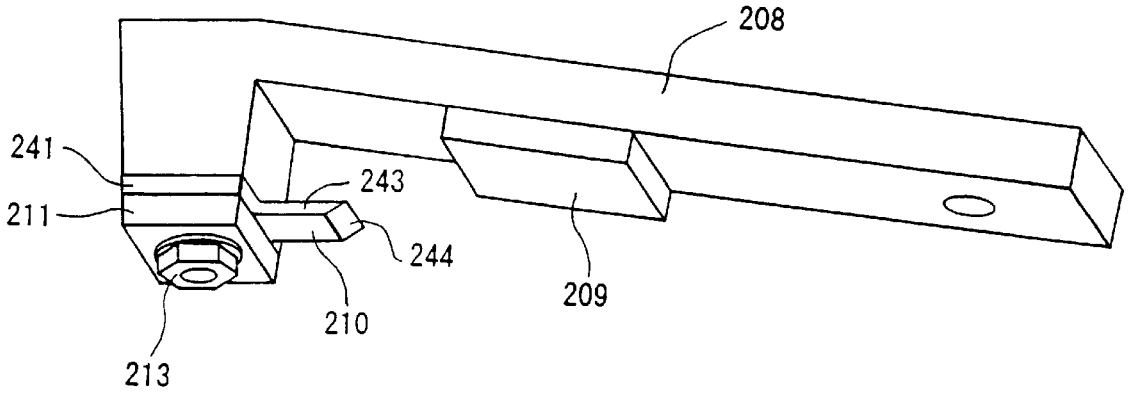
FIG. 17 is a perspective view of a fixed control portion in the action mechanism of FIG. 15.
Figure 18A:
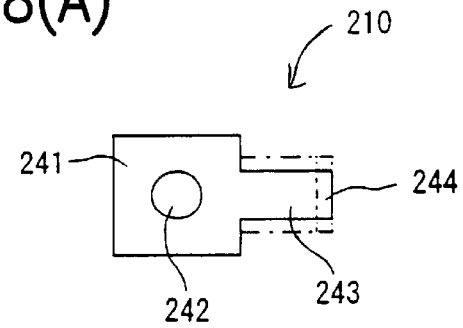
FIG. 18 is a plan view illustrating an example of a rubber member attached on the top end of the fixed control portion in the action mechanism of FIG. 15.
Figure 18B:
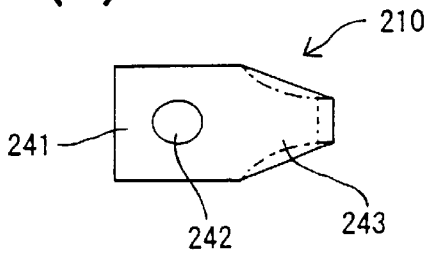

As shown in FIGS. 17 and 18(A), the rubber member 210 is comprised of a square-shaped base portion 241, a through hole 242 in which the bolt 212 is inserted, a rectangular mounting portion 243 over which the moving-over portion for repeated striking 205 moves, and a top end portion 244 having a top end protruding in a triangle shape. Further, the rubber member 210 may have a wider mounting portion 243 as shown by an alternate long and short dot line of FIG. 18(A), or may have a trapezoidal mounting portion 243 as shown in FIG. 18(B). Alternatively, the rubber member 210 may have an angular mounting portion having both side portions formed of a recess-shaped curved line as shown by an alternate long and short dot line of FIG. 18(B). In this way, elasticity (bend) can be adjusted. In addition, the rubber member 210 is replaceable and its protruding position can be adjusted.

Operations of the action mechanism 201 used in the keyboard musical instrument of this sixth embodiment will now be described based on FIGS. 15 through 19 and 24. Further, FIGS. 19 through 23 illustrate only the parts necessary for the description of operations.

In FIG. 15, when a performer strikes a key of the keyboard portion 103, the keyboard body 105 starts to pivot in the clockwise direction (in FIG. 15) with the pin 221 and the supporting portion 184 as a center. At this time, the screw union 123 to be a rotational center of the hammer body 202 rises in the key striking direction, that is, in the direction of the string 7 side. By this rising, the beak-like engaging piece 119 of the hammer body 202 engages the lower surface of the engaging portion 131 of the escapement member 207.

When the keyboard portion 103 is further depressed, since the shift of the beak-like projecting piece 119 is prevented by the engaging stepped portion 131, the hammer portion 203 side of the hammer body 202 further pivots to the string 7 side. At this time, the operation block 112 to be a pushing-out member of the hammer body 202 gradually pushing out the escapement member 207 to its back side (the right side in FIG. 15) against the elasticity (biasing force) of the coil spring 141.

Figure 19:
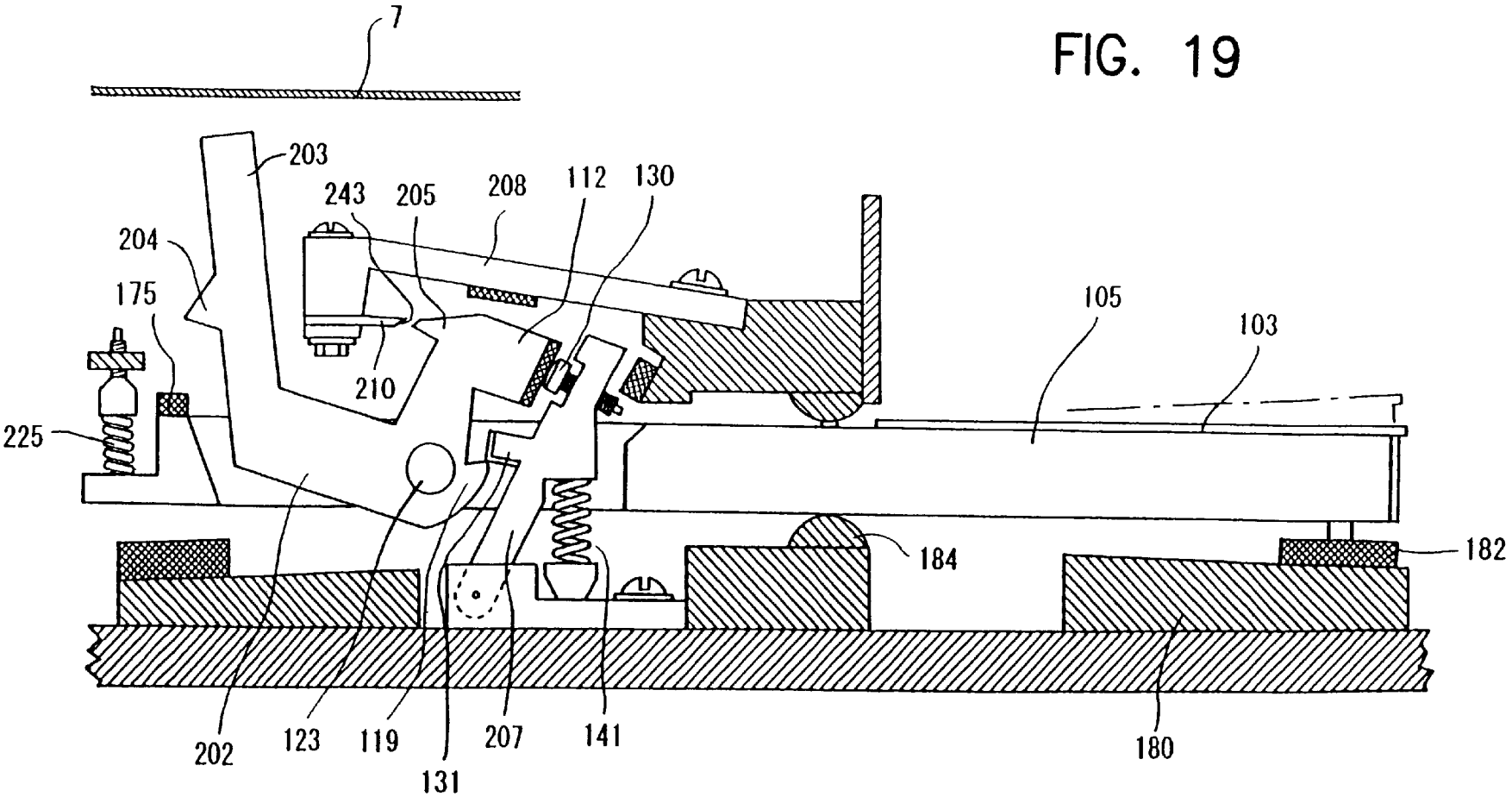
FIG. 19 is a side view illustrating the state immediately after starting key striking in the action mechanism of FIG. 15.
Figure 20:
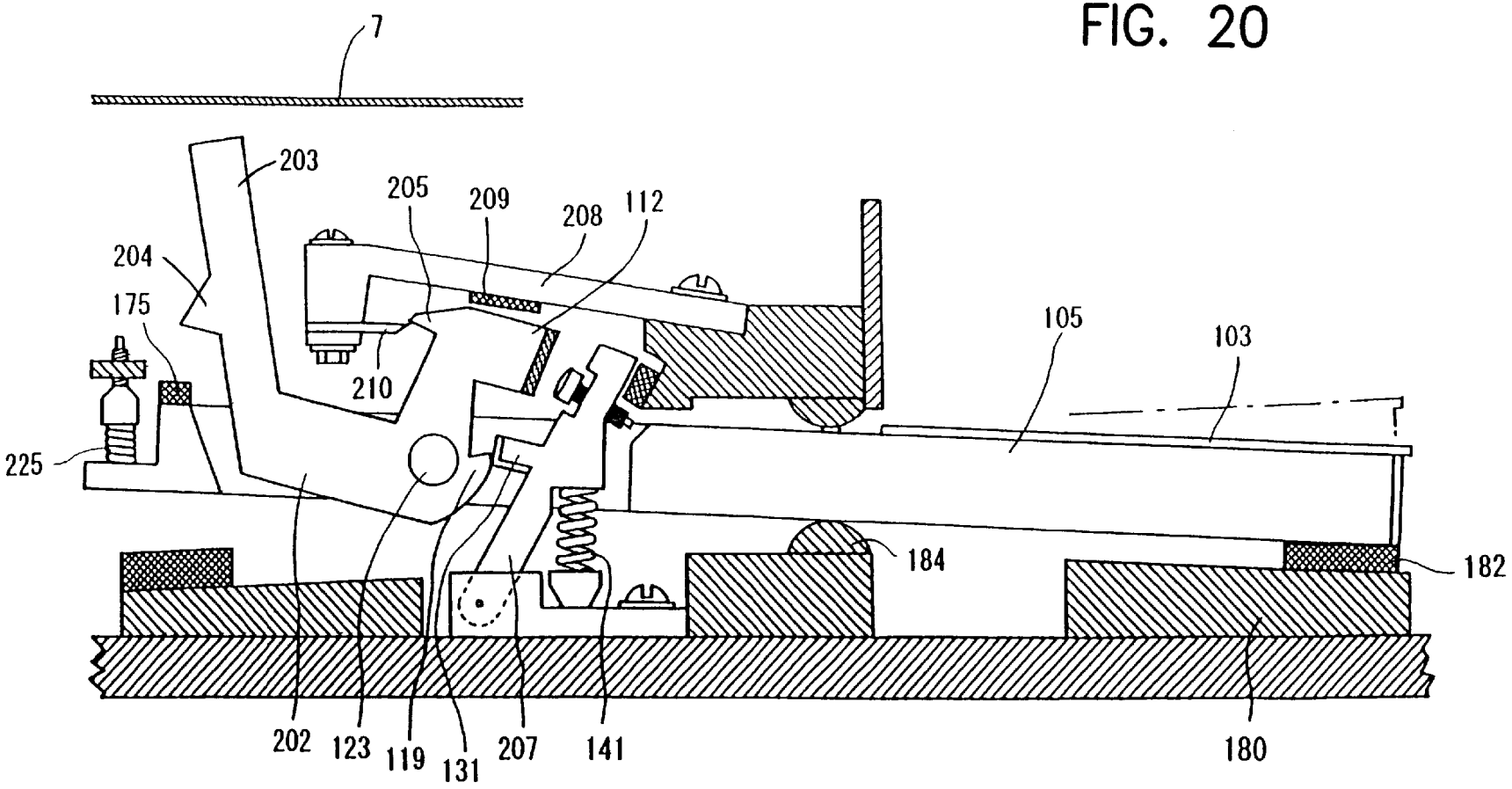
FIG. 20 is a side view showing the state immediately after striking a string in the action mechanism of FIG. 15.

At this time, as shown in FIG. 19, the moving-over portion for repeated striking 205 passes without colliding with the tongue piece like mounting portion 243 of the rubber member 210 fixed in the fixing control portion 208. Then, the hammer portion 203 of the hammer body 202 strikes the string 7, immediately before which the escapement member 207 is completely pushed out to the back portion side by the operation block 112 of the hammer body 202 against the elasticity of the coil spring 141. As a result, the beak-like projecting piece 119 of the hammer body 202 is let off from the lower surface of the engaging stepped portion 131.

Thereafter, the hammer portion 203 of the hammer body 202 strikes the string 7 by the clockwise pivoting of the entire keyboard body 105 (the hammer portion 203 rises) while continuing the rotational operation by inertia. After striking the string 7, the hammer portion 203 is forced back to the lower side (in each figure) by the repulsion of the string 7. As a result, the hammer body 202 rotates in the opposite direction.

Further, at the time of striking, the beak-like projecting piece 119 of the hammer portion 203 of the hammer body 202 is positioned higher (in the figure) than the lower surface of the engaging stepped portion 131 of the escapement member 207. Therefore, when the escapement member 207 returns from its retreated position by elasticity of the coil spring 141, the beak-like projecting piece 119 abuts the return sliding surface which is higher than the lower surface of the engaging stepped portion 131 (see FIG. 20).

Figure 24:
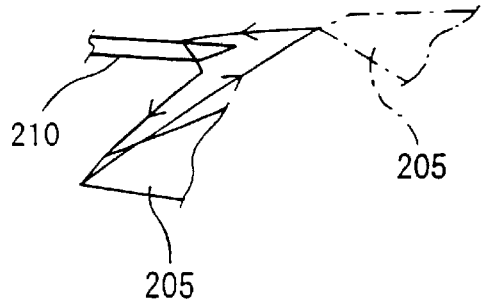
FIG. 24 is a view illustrating the moving track of the top end of the moving-over portion for repeated striking of the hammer body in the action mechanism of FIG. 15.

In this state after striking, the moving-over portion for repeated striking 205 starts to move over the mounting portion 243 of the rubber member 210. This is because rotation of the hammer body 202 takes place with the screw union 123 portion that is shifted upward as a center after striking, that is, after the engaging stepped portion 131 is let off. For ease of understanding of this operation, the track of the top end of the moving-over portion for repeated striking 205 is shown in FIG. 24. Further, a letter S shaped bend in the return stroke in the track shown in FIG. 24 is caused by the mounting portion 243 bending, after the moving over portion for repeated striking 205 moves over the mounting portion 243.

Figure 21:
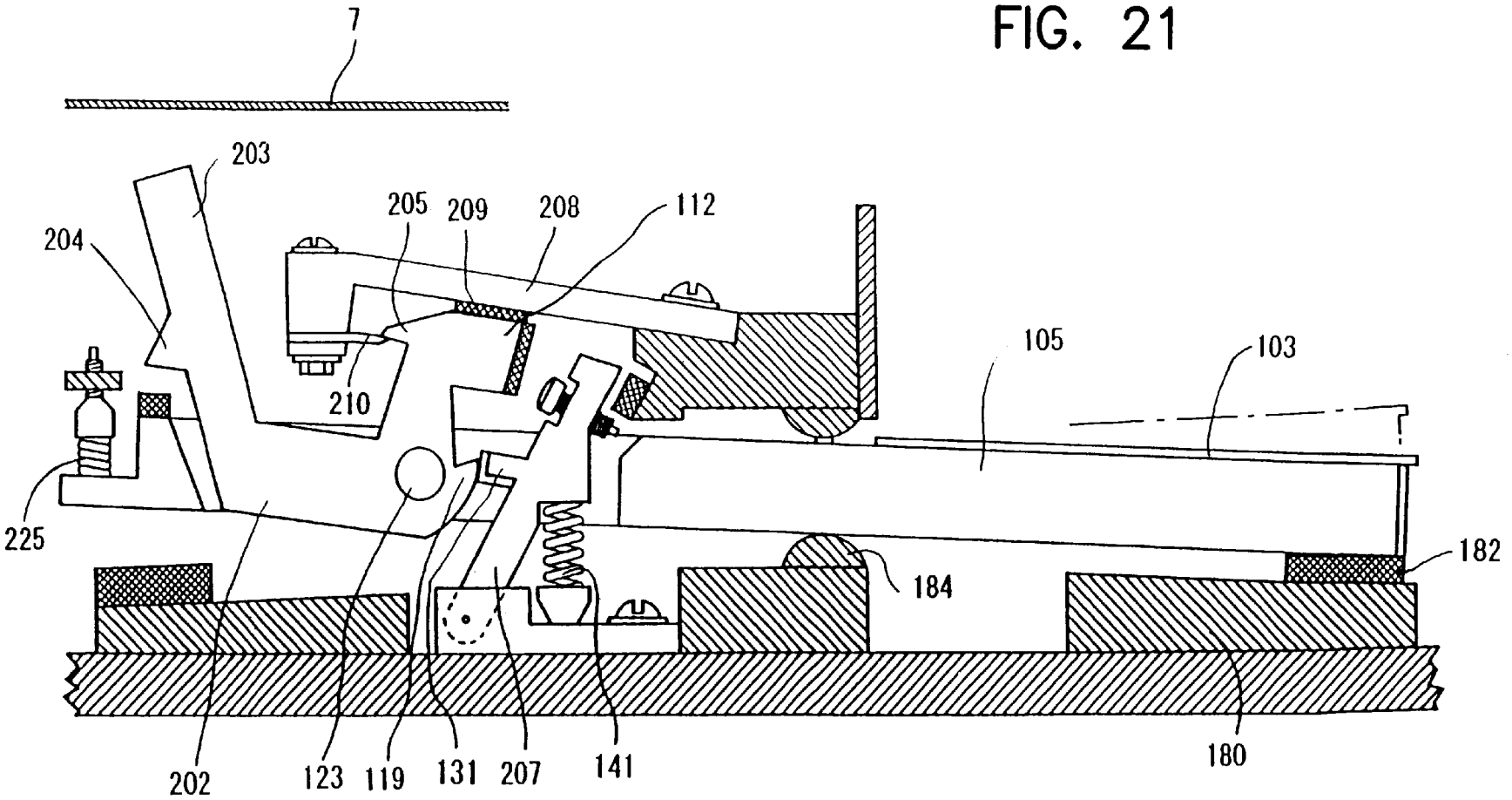
FIG. 21 is a side view illustrating the state in which a moving-over portion for repeated striking of the hammer body has moved over a mounting portion after finishing string striking in the action mechanism of FIG. 15.

When this moving-over takes place, the upper face of the base end of the hammer body 202 abuts the cushion portion 209 of the fixing control portion 208, by which the hammer body 202 is stopped, in the state in which the hammer portion 203 is separated from the string 7 (see FIG. 21). That is, the upper surface of the operation block 112 of the hammer body 202 sticks to the lower surface of the cushion portion 209 by the pivoting force in the clockwise direction from the keyboard portion 103 and the position preserving force of the fixing control portion 208, and pivoting in the counter clockwise direction (in the figure) of the hammer body 202 is prevented, and pivoting in the clockwise direction (in the figure) of the hammer body 202 based on the repulsion at the time of collision of the cushion portion 209, and the hammer body 202 is also prevented. In this way, since the pivoting of the hammer body 202 is stopped by the fixing control portion 208, the hammer body 202 does not rebound to strike the string 7 again.

Figure 22:
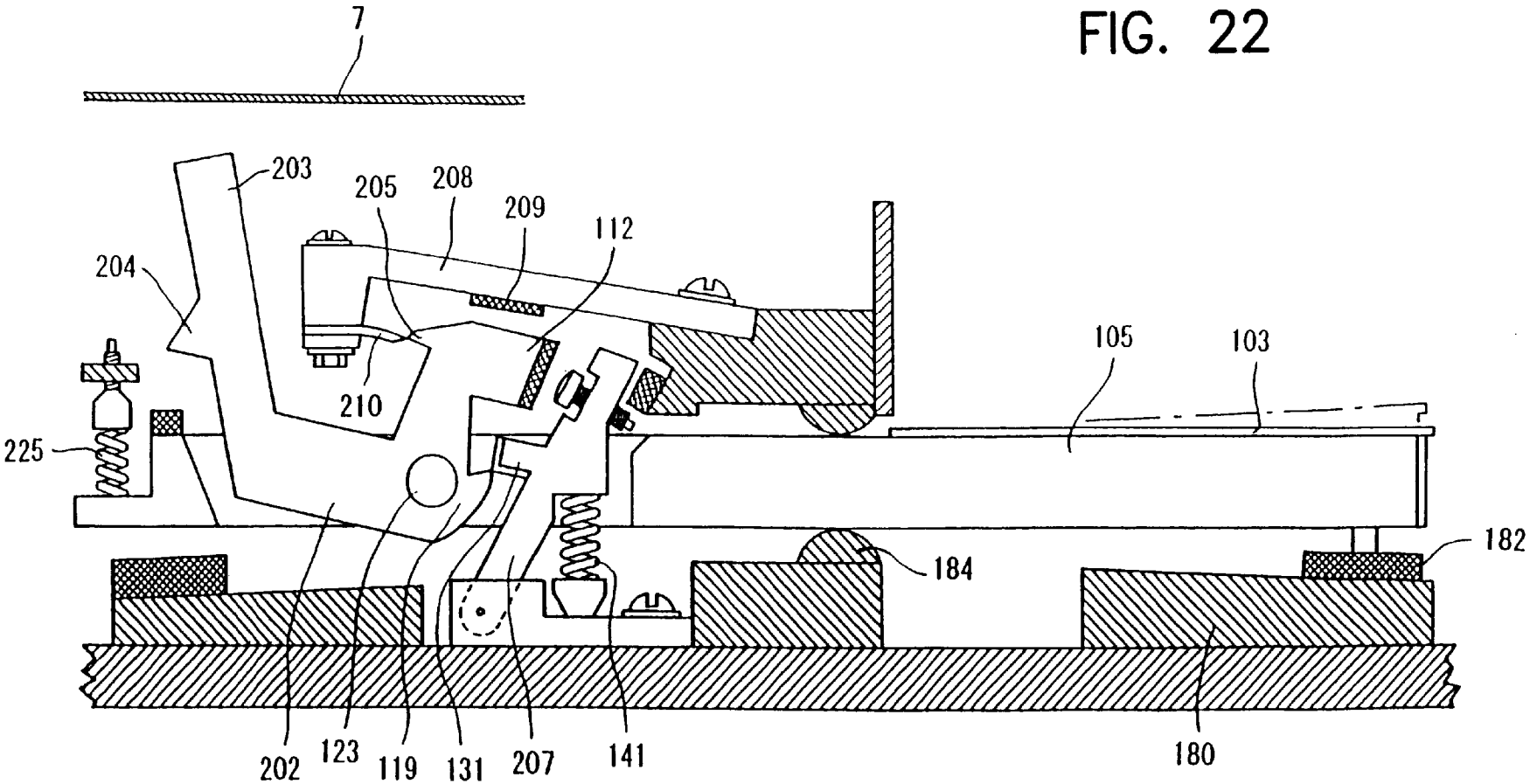
FIG. 22 is a side view illustrating the state immediately before the moving-over portion for repeated striking of the hammer body comes off from the mounting portion after finishing string striking in the action mechanism of FIG. 15.

Thereafter, when the keyboard portion 103 is raised, the mounting portion 243 continues to support moving-over portion for repeated striking 205 while bending (see FIG. 22). When the moving-over portion for repeated striking 205 is about to come off from the mounting portion 243, the beak-like projecting piece 119 is about to enter under the lower surface of the engaging stepped portion 131. The beak-like projecting piece 119 returns to the engagement with the lower surface of the engaging stepped portion 131 utilizing the elasticity of the coil spring 141 simultaneously with or immediately before the moving-over portion for repeated striking 205 coming off from the mounting portion 243.

Figure 23:
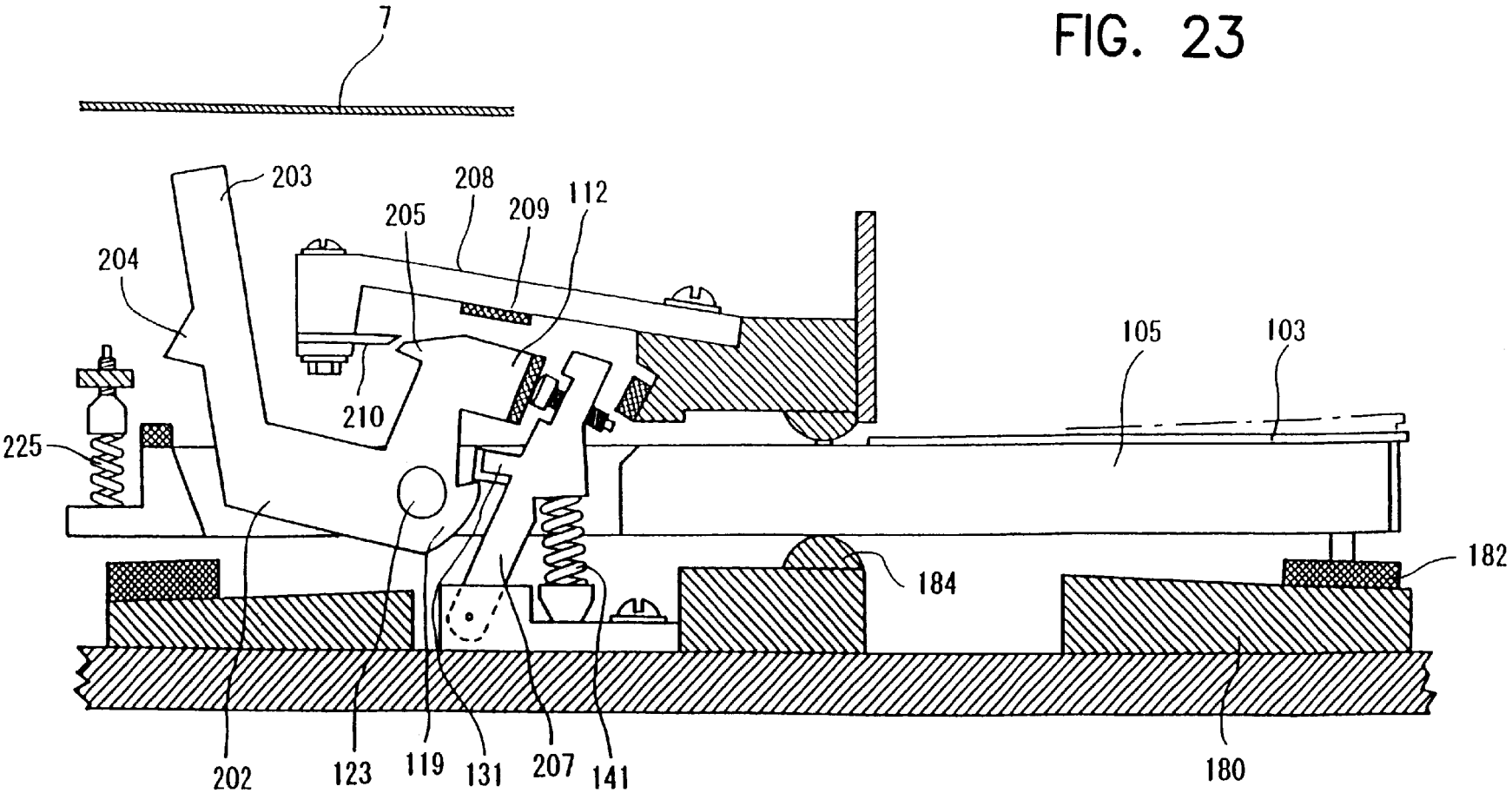
FIG. 23 is a side view illustrating the state immediately after the moving-over portion for repeated striking of the hammer body has come off from the mounting portion after finishing string striking in the action mechanism of FIG. 15.

The state in which the beak-like projecting piece 119 starts to return to the lower surface of this engaging stepped portion 131 is shown in FIG. 23. The state immediately before the beak-like projecting piece 119 is about to completely engage or has completely engaged the lower surface of the engaging portion 131 arises before the keyboard body 105 returns to the original state as shown in FIG. 23. Therefore, the keyboard portion 103 can be depressed to strike the string again, before the state in which the keyboard portion 103 rises to the highest, i.e., the state before key striking shown in FIG. 5. That is, a repetition that is a faster repeated striking becomes possible. To show an example of concrete numerical values, if the possible amount of depressing the keyboard portion 103 is 8 mm, a key striking operation is possible again at the time when the keyboard portion 103 returns by 4.5 mm from the depressing completed point.

Figure 25:
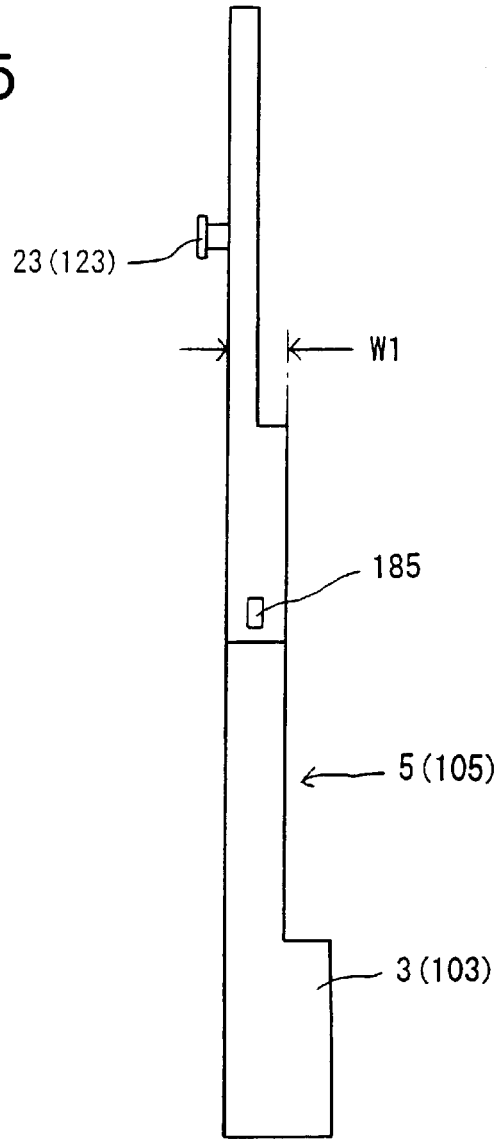
FIG. 25 is a plan view illustrating an example of a modification of the keyboard body.

Further, although each of the above-mentioned embodiments is an example of a preferred embodiment of the present invention, the present invention is not limited to these embodiments, but may be modified in various ways within the scope not departing from the spirit of the present invention. For example, as shown in FIG. 25, in the keyboard bodies 5 and 105, the screw union 23 (123) may be disposed such that the screw union 23 (123) protrudes in the side surface side forming one flat surface in the longitudinal direction. Further, these keyboard bodies 5 and 105 has the width W1 of approximately 10 mm. This width W1 is identical with the width of the keyboard portion 103 in the semitone part, and is the standard in the latitudinal direction of the keyboard bodies 5 and 105.

Figure 26:
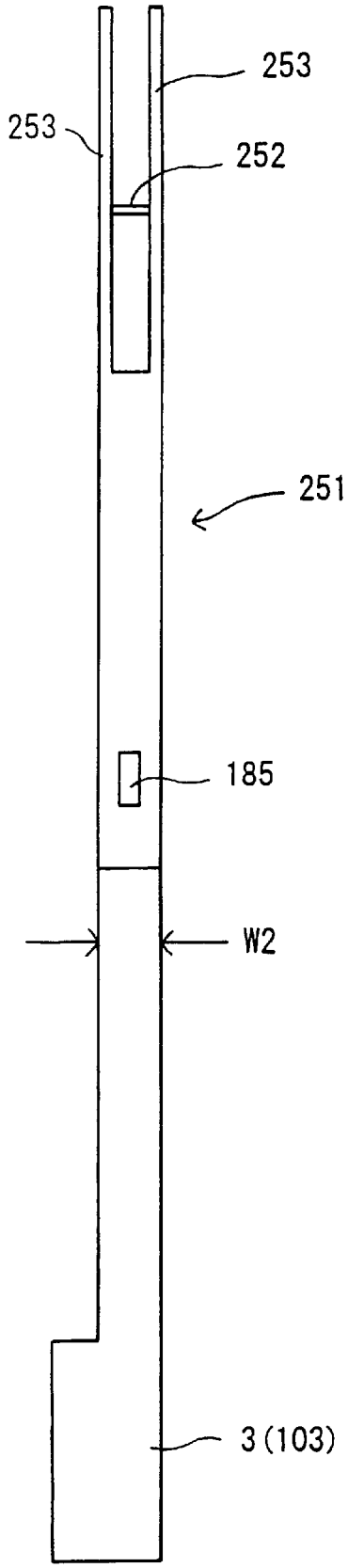
FIG. 26 is a plan view illustrating another example of a modification of the keyboard body.

The structure of the keyboard body may be the one shown in FIG. 26. The keyboard body 251 shown in FIG. 26 is preferably applied to a keyboard musical instrument using a general sized keyboard. In this keyboard body 251, a part corresponding to the screw union 23 (123) is a bridge-like rotational central portion 252 that is laid between and suspends two top end portions 253 forming a fork-like structure. In this keyboard body 251, a hammer body and an escapement member are disposed between both the top end portions 253, and the hammer body is pivotally attached to the rotational central portion 252.

Figure 27A:
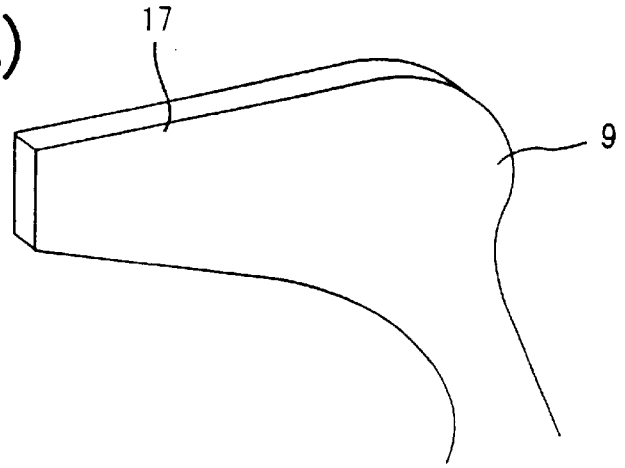
FIG. 27 is a perspective view illustrating various kinds of examples of the top end of the hammer portion.
Figure 27B:
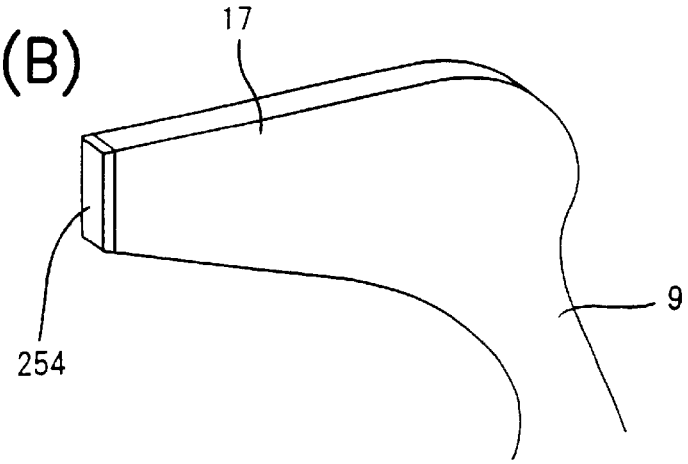
Figure 27C:
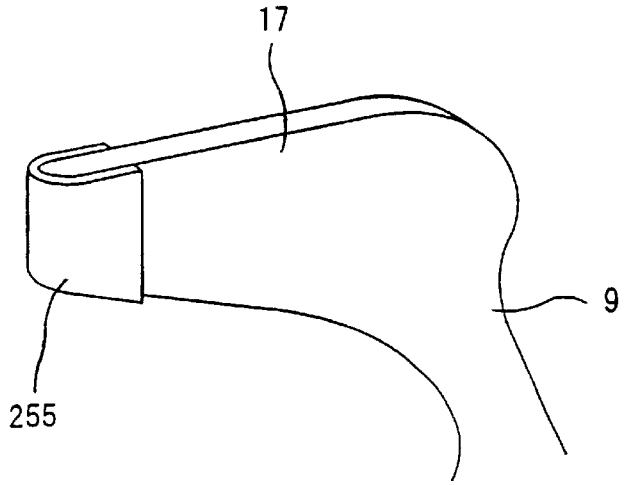

The material of the hammer bodies 9, 67, 109, 172 and 202 is preferably wood, but may be other materials such as synthetic resin. In addition, the top end of the hammer portion (the hammer portion 17 is shown as a typical example) of each hammer body (the hammer body 9 is shown as a typical example) may be the same material as that of the hammer body as shown in FIG. 27(A), i.e., the same material as the one used in the first embodiment, but when the quality of sound is desired to be adjusted, a top end portion 254 made of leather or felt may be stuck and fixed as shown in FIG. 27(B). In addition, the top end of the hammer portion of each hammer body may be a covering top end portion 255 that covers the both side surfaces of the top end as shown in FIG. 27(C).

Figure 28A:
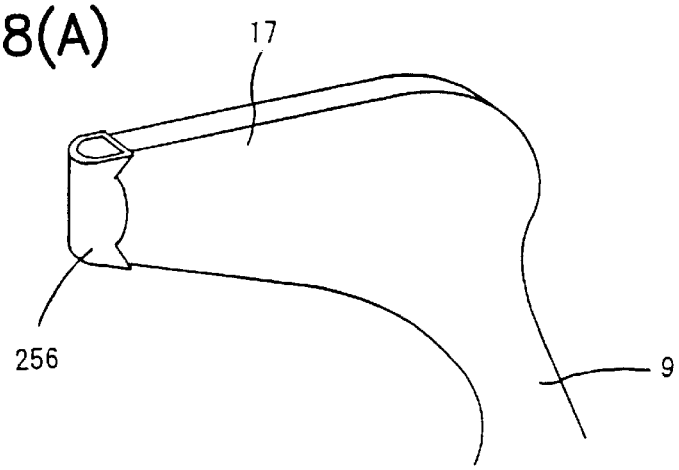
FIG. 28 illustrates examples for attaching rubber to the top end of the hammer portion, in which (A) is a perspective view illustrating the state in which rubber is attached to the top end of the hammer portion; (B) is a view illustrating rubber to be attached to the top end of the hammer portion; and (C) is a perspective view of the top end of the hammer portion.
Figure 28B:
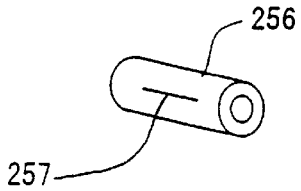
Figure 28C:
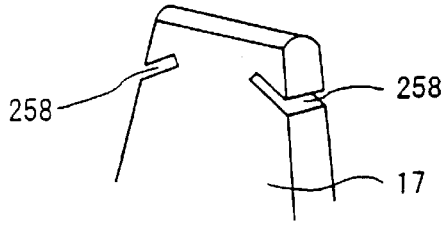

Moreover, rubber 256 may be attached to the top end of the hammer portion of each hammer body as shown in FIG. 28. The rubber 256 is cylindrical and has one slit 257 on its side surface as shown in FIG. 28(B). A notched recessed portion 258 is provided in both sides of the top end of the hammer body 17 such that the rubber 256 does not slip out. Then, when the rubber 256 is attached to the top end of the hammer body 17 by opening the slit 257, the state shown in FIG. 28(A) is attained.

Figure 29:
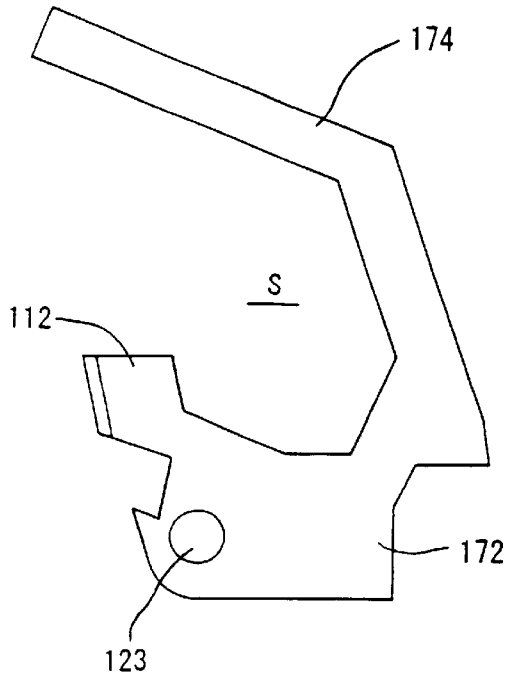
FIG. 29 is a view showing an example of a modification of the hammer body.

Devices of the top end shape of the hammer body or of attaching members such as leather, felt, rubber and the like on the top end portion can be similarly applied to the parts of the engaging stepped portions 31 and 131 where the beak-like projecting pieces 19 and 119 abut. As the shape of the hammer body 172, the hammer portion 174 is made longer and a space S is provided between the hammer portion 174 and the operation block 112, as shown in FIG. 29, such that other parts such as a fixed portion may be disposed in this space S.

Moreover, the shapes of the beak-like projecting pieces 19 and 119 and the engaging stepped portions 31 and 131 may be modified respectively as shown in each drawing of FIG. 30. Further, the shapes of the beak-like projecting piece 119 and the engaging stepped portion 131 are shown as examples in each drawing.

Figure 30A:
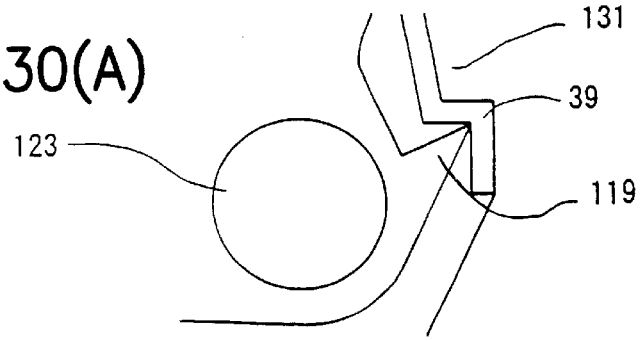
FIG. 30 illustrates various kinds of examples of each engaging part of a beak-like projecting piece of the hammer body and an engaging stepped portion of the escapement member.
Figure 30B:
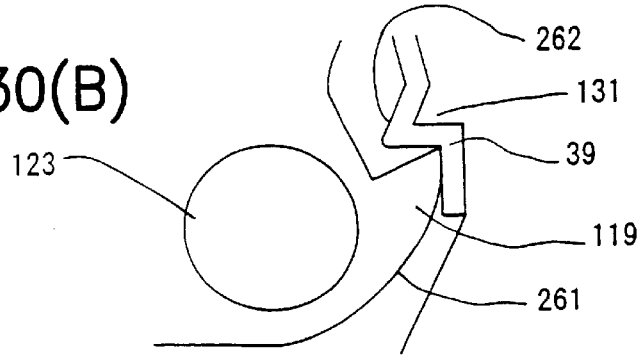

FIG. 30(A) shows a structure in which the top end of the beak-like projecting piece 119 is made triangle and the engaging stepped portion 131 is made step-like, both of which are clearly shown by drawing their appearance with straight lines. FIG. 30(B) shows a structure in which a curved surface portion 261 that is the underside of the beak-like projecting piece 119 forming a convex curved line, and on the other hand, the engaging stepped portion 131 forms an acute angle at the top end portion of FIG. 30(A), and the return sliding surface 39 to be stuck to its surface also made a triangle portion 262 in accordance with the shape.

Figure 30C:
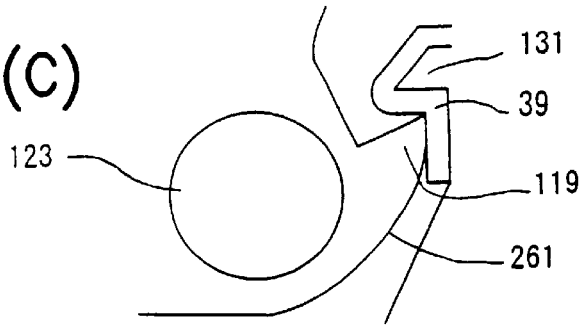
Figure 30D:
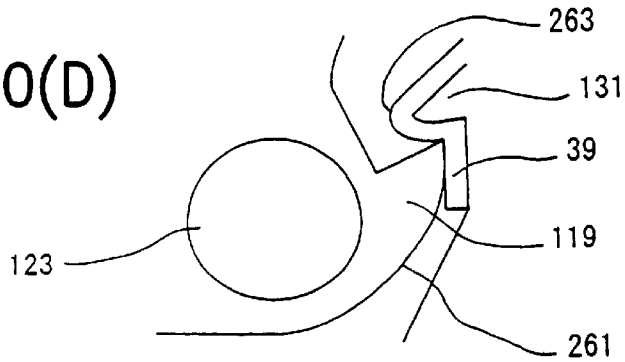
Figure 31:
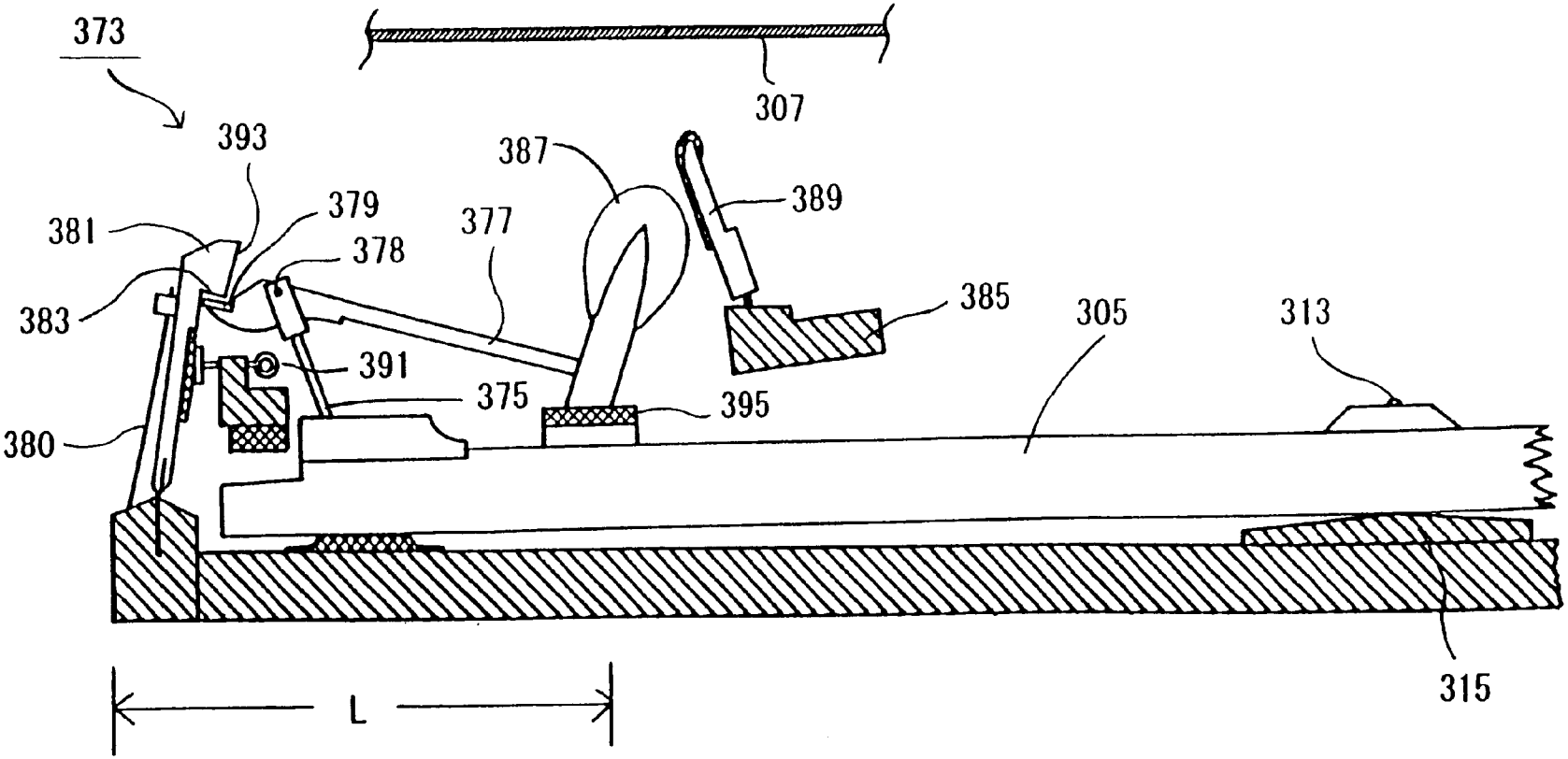
FIG. 31 is a side view illustrating an action mechanism used in a conventional jumping-up keyboard musical instrument and its operation in a stationary state immediately before starting key striking.
Figure 32:
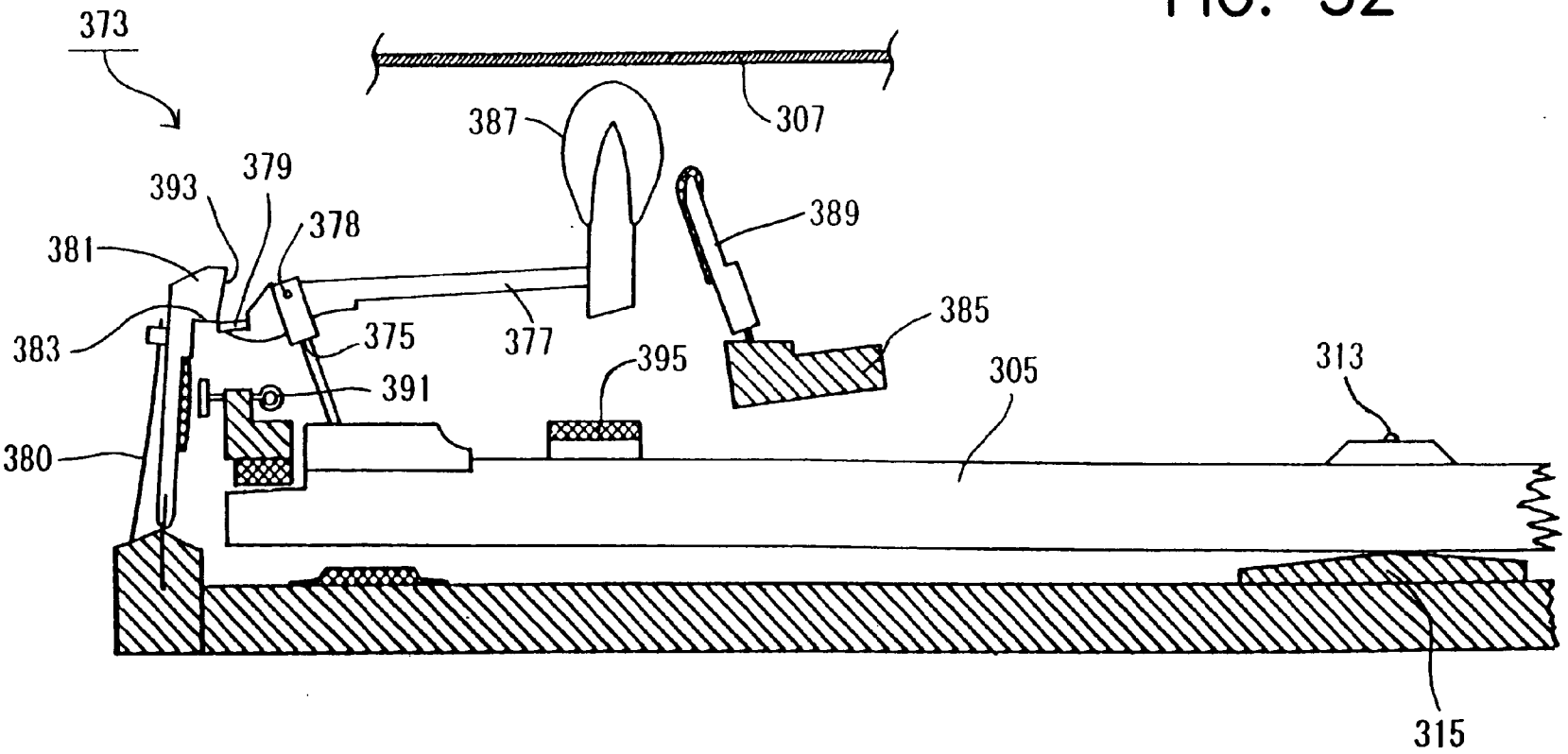
FIG. 32 is a side view illustrating the state immediately before starting string striking in the action mechanism of FIG. 31.
Figure 33:
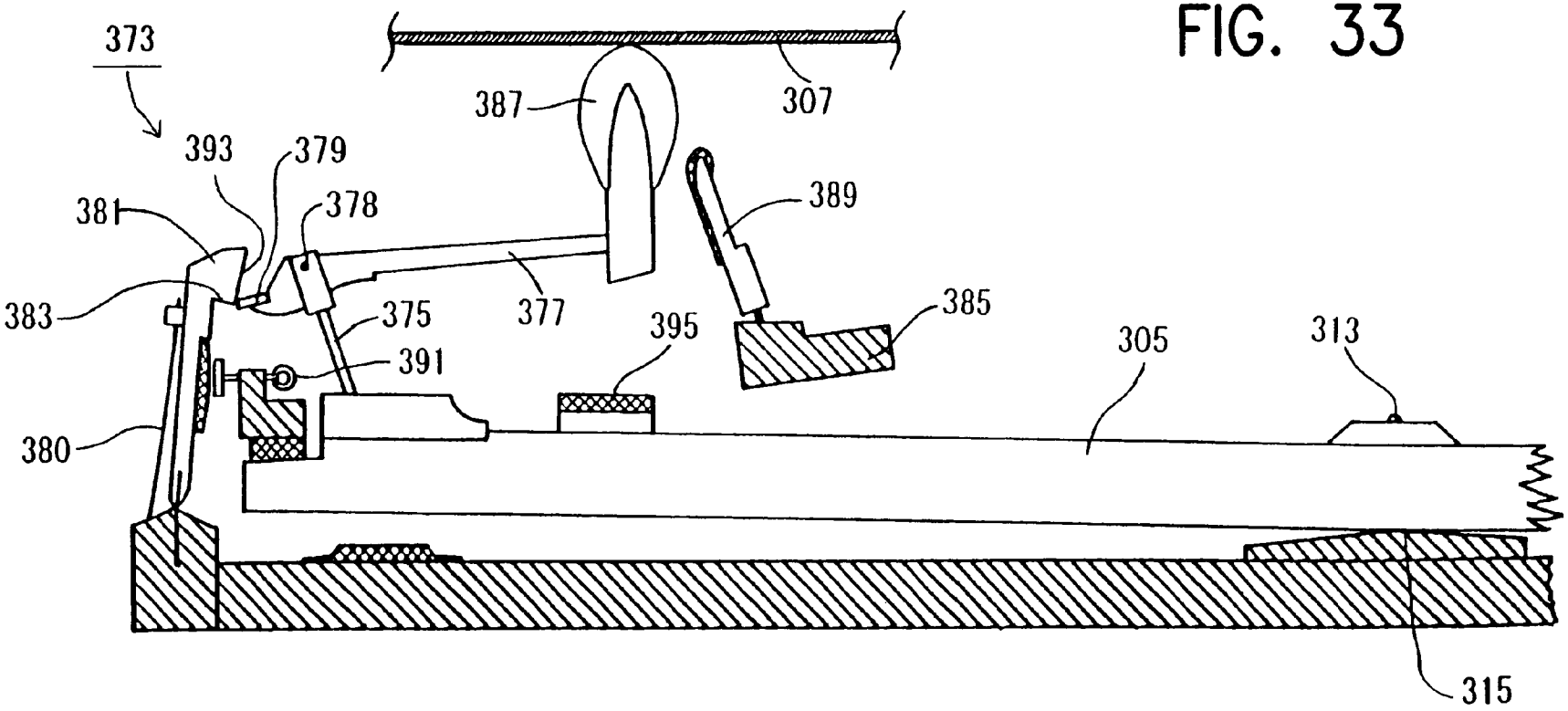
FIG. 33 is a side view showing the state at the time of striking a string in the action mechanism of FIG. 31.
Figure 34:
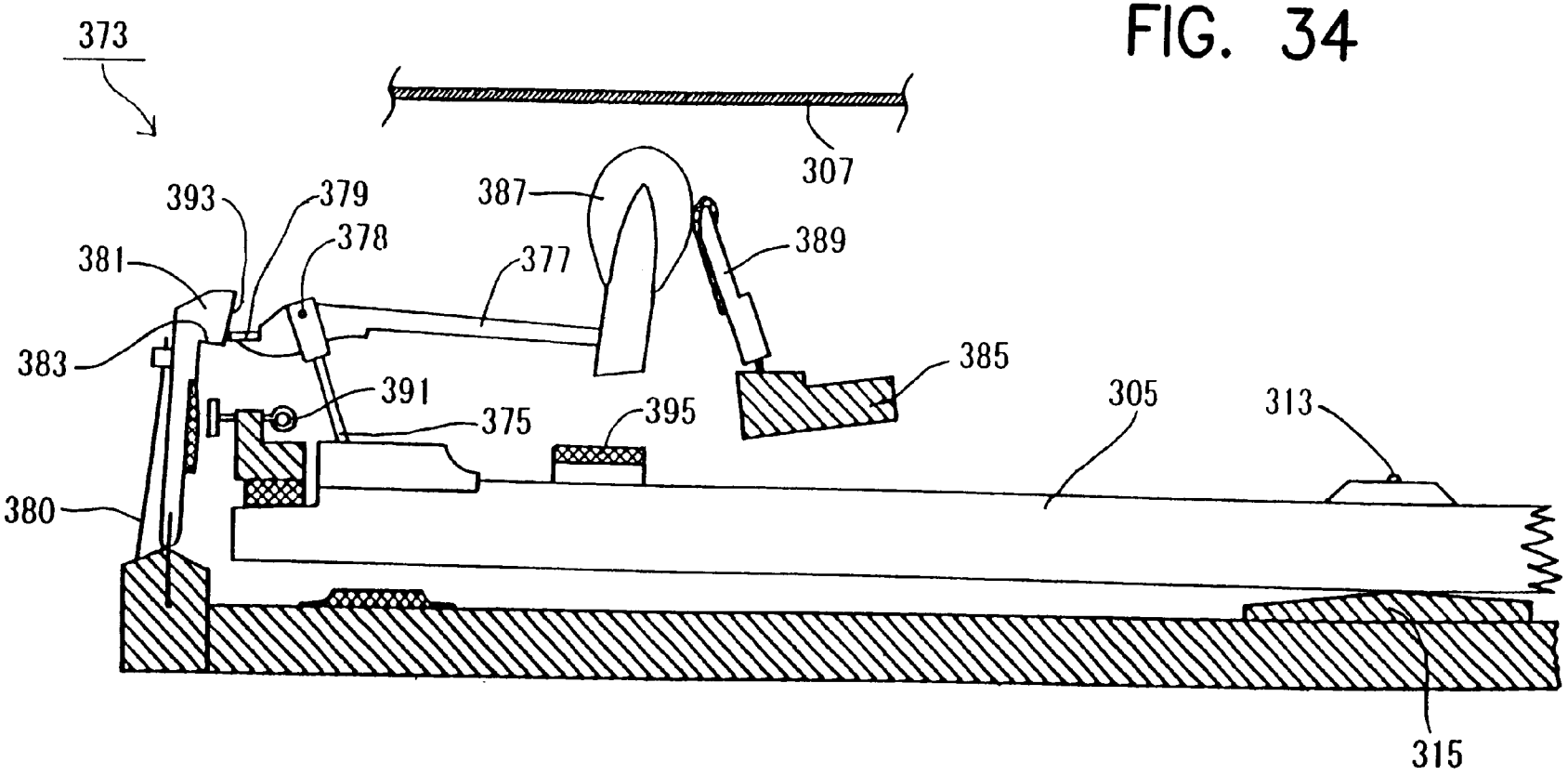
FIG. 34 is a side view illustrating the state in which the force of the hammer body is reduced by a back-check after striking a string in the action mechanism of FIG. 31.

FIG. 30(C) shows a structure in which the beak-like projecting piece 119 has the same shape as that of FIG. 30(B) and the engaging stepped portion 131 is made beak-like. In addition, FIG. 30(D) shows a structure which is different from that of FIG. 30(C), in that the lower surface of the beak-like engaging stepped portion 131 is formed more rounder and a round portion 253 is provided.

Due to the variation of the shapes as shown in FIGS. 30(A) through (D), feeling of play (touch) and the motion of the hammer body (mainly return condition of the hammer body after striking a string) changes. Preferably, these shapes are appropriately modified in accordance with purposes of use, structures of other parts and the like.

Further, the cushion material 175 in the rear upper part of the keyboard body 105 disposed in the action mechanisms 171 and 201 of the fifth and the sixth embodiments, is for easily transmitting the motion of the keyboard body 105 to the hammer bodies 172 and 202, at the same time, for erasing a return sound when the hammer bodies 172 and 202 return to the original positions, and for helping them to return to the stationary state, but the cushion material 175 may be applied to other embodiments.

In addition, in each of the above-mentioned embodiment, a keyboard musical instrument is a portable one, but it may be a larger keyboard musical instrument such as an electronic organ, an upright piano, and a grand piano.

Further, if a damper of a sound generating body is added to each action mechanism in the keyboard musical instrument in each of the above-mentioned embodiment, the method used in the conventional keyboard musical instrument can be adopted without any change. In addition, although the keyboard musical instrument can operate even if the control member attached to the escapement member and the fixing control portion fixed on the machine base are removed, its motion is not stable and repeated striking is difficult because the hammer body rebounds. However, the control member and the fixing control portion may be removed for a toy, a musical instrument for infants and the like.

In addition, in this embodiment and modification examples, although the arrangement surfaces of the keyboard portions 3 and 103 and the arrangement surface of the string 7 are made parallel and the entire keyboard musical instrument is formed in a flat shape, it is possible to have a keyboard musical instrument of an upright piano type with the string 7 arranged in the perpendicular surface direction with respect to the keyboard portion 3 and 103 (the opposing surface with respect to a performer) by making the hammer body in the present invention to be bent upward from the arm portion, that is, by having the same configuration as that of the fifth embodiment.

In addition, although the string 7 and the bar-like metal plate 173 are used as a sound generating body in each embodiment, sound generating bodies other than these such as that made of glass or a bell may be used as the sound generating body of the present invention. Further, various known conventional shapes and structures may be adopted for the hammer bodies 9, 67, 109, 172 and 202.

In addition, since the touch of performance in letting off the hammer bodies 9, 67, 109, 172 and 202 is exactly the same as that of a general piano in each action mechanism of the present invention, the present invention may be applied to a silent keyboard for practice use by using a cushion instead of the sound generating body, and the present invention may be further applied to an electronic musical instrument by using a sensor for an electronic musical instrument instead of the sound generating body, hence, these configurations belong to the category of the present invention. In addition, other elastic members such as a rubber member or a metal Belleville spring may be used instead of the coil springs 106, 141 and 255. Moreover, although the engaging stepped portions 31 and 131 are formed in a protruding shape in each embodiment, these may be formed in a recessed shape, and the upper inside surface of the recessed portion may be made to have the same function as the lower surface of the engaging stepped portion 31 and 131.

Furthermore, most of the respective improvements of the present invention are not limited to the configuration in which the hammer bodies 9, 67, 109, 172 and 202 is directly attached to the keyboard bodies 5 and 105, but can be applied to the configuration in which the hammer body 377 is attached to the supporting pole 375 as in the conventional keyboard musical instrument.

Industrial Applicability

As described above, the keyboard musical instrument in accordance with the present invention can be used as a keyboard musical instrument not only in a usual concert of amateur performers but also in a concert of professional performers because the tone is stable and the quality of performance is improved, even if it is the jumping-up style due to the decreased dislocation of a striking sound generating point. In addition, since the action mechanism portion is small in terms of the height and the depth, it can be easily manufactured as a portable keyboard musical instrument. Moreover, since standing play by holding it in hands and the like are also possible even if it is the jumping-up style, a keyboard musical instrument that is extremely easy to utilize without being restricted by a place of performance is provided.

What is claimed is:

1. A keyboard musical instrument characterized in that a middle part in the longitudinal direction of a keyboard body having a keyboard portion at its one end is swingably held and, at the same time, a base of a hammer body for striking is pivotally attached to the opposite side of said keyboard portion across the holding point of said keyboard body; a beak-like projecting piece is protrudingly provided in a base end of said hammer body, and at the same time, an engaging stepped portion is formed in an escapement member that is always biased toward said beak-like projecting piece of the hammer body; the pivotally attached portion of said hammer body pivots in accordance with a key striking operation of said keyboard portion, and at the same time, said beak-like projecting piece of said hammer body and said engaging stepped portion of said escapement member engage; and said hammer body performs a striking pivotal operation against a sound source body, and that in at least one of said base end of said hammer body and said escapement member, a pushing-out member for pushing out said escapement member to the opposite side with respect to said hammer body in accordance with the striking pivotal operation of said hammer body to let off the beak-like piece of the hammer body from said engaging stepped portion, and at the same time, integrally forms in said escapement member a control means contactably and separably opposing said hammer body in the striking direction that separates said hammer body from said sound source body and stopping it in the state in which said beak-like projecting piece is let off from said engaging stepped portion.

2. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and at least one of said hammer body and said escapement member is provided with a pushing-out member for pushing out said escapement member to the opposite side with respect to said hammer body to separate said projecting piece of said hammer body from said engaging stepped portion in accordance with a striking pivotal movement of said hammer body.

3. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and integrally forms in said escapement member a control means separably opposing said hammer body in the striking direction for separating said hammer body from said sound source body and stopping it in the state in which said beak-like projecting piece is let off from said engaging stepped portion.

4. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and a fixed member fixed in a base for holding said keyboard body is provided with a control member separably opposing said hammer body in the striking direction, for abutting said base end, separating said hammer body from said sound source body and stopping it in the state in which said projecting piece is let off from the engaging stepped portion.

5. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and a pushing out member for pushing out said escapement member to the opposite side with respect to said hammer body to separate said projecting piece of said hammer body from said engagement portion, is formed in a shape projecting toward said sound source side with respect to an extended line of said arm portion of said hammer body.

6. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and a recessed portion is provided in said sound source body direction side of said engaging stepped portion of said escapement member, an operation block is provided as if getting into said recessed portion in said sound source body direction side of said projection piece of said hammer body, and an elastic member for always biasing said escapement member toward said sound source body direction is provided in the opposite side of the said sound source body direction of said escapement member.

7. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and an elastic member for biasing said keyboard body to the opposite side with respect to said sound source body direction is provided.

8. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and a structure for pivotally fixing said hammer body is provided with holes in said keyboard body and said base of said hammer body respectively, a screw union having a female screw inside is put in said holes, and screw union having a male screw is incorporated from the surface opposite the surface on which said hammer body abuts said keyboard body such that said screw union engages said female screw.

9. A keyboard musical instrument characterized by comprising a keyboard body that has a keyboard portion in its one end portion and is held at the middle part in the longitudinal direction to be made swingable; a hammer body having a hammer portion for striking that is pivotally fixed at its base in the opposite side of said keyboard portion across the swinging central point of said keyboard body; and an escapement member always biased toward said hammer body, and characterized in that said keyboard musical instrument is provided with a projecting piece in the opposite side of said hammer portion across the pivotal fulcrum of said hammer body; and an engaging stepped portion for engaging said projecting piece that is mounted in said escapement member, and that said keyboard musical instrument is further configured such that said projecting piece of said hammer body and said engaging stepped portion of said escapement member are engaged and said hammer body performs a striking pivotal operation against said sound source body when the pivotal fulcrum of said hammer body pivots in the striking direction by a key striking operation of said keyboard portion, and said escapement member is disposed in said keyboard portion side with respect to said pivotal fulcrum that becomes the fixed portion of said hammer body and said keyboard portion.

* * * * *

UNITED STATES PATENT AND TRADEMARK OFFICE

CERTIFICATE OF CORRECTION

PATENT NO. : 6,329,585 B1
DATED : December 11, 2001
INVENTOR(S) : Yasuhiro Chono It is certified that error appears in the above-identified patent and that said Letters Patent is hereby corrected as shown below:

Title page,
Item [76], Inventor, change "Room No. 201, Rose Mension 30-21, Takadanobaba 4-Chome," to -- Room No. 205, Green Heights 39-9, Takadanobaba 3-Chome, --.

Signed and Sealed this

Tenth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,329,585 B1
APPLICATION NO. : 09/701959
DATED : December 11, 2001
INVENTOR(S) : Chono It is certified that error appears in the above-identified patent and that said Letters Patent is hereby corrected as shown below:

On the Title Page:

Item (76), Inventor: Please delete "Room No. 201, Rose Mension 30-21, Takadanobaba 4-chome, Shinjuku-ku, Tokyo 169-0075 (JP)" and insert --11-6, Senjuazuma 1-chome, Adachi-ku, Tokyo 120-0025, Japan--

Signed and Sealed this
Fourth Day of September, 2012

David J. Kappos

David J. Kappos
*Director of the United States Patent and Trademark Office*